US009268244B2

(12) United States Patent
Fukao et al.

(10) Patent No.: US 9,268,244 B2
(45) **Date of Patent: *Feb. 23, 2016**

(54) ELECTROSTATIC IMAGE DEVELOPING TONER, IMAGE FORMING APPARATUS, IMAGE FORMING METHOD, AND PROCESS CARTRIDGE

(75) Inventors: Tomohiro Fukao, Osaka (JP); Takuya Kadota, Hyogo (JP); Yoshihiro Mikuriya, Hyogo (JP); Tsuyoshi Nozaki, Osaka (JP); Yoshimichi Ishikawa, Hyogo (JP); Kazuoki Fuwa, Hyogo (JP); Tomoharu Miki, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/113,487

(22) PCT Filed: Apr. 25, 2012

(86) PCT No.: PCT/JP2012/061629

§ 371 (c)(1),
(2), (4) Date: Oct. 23, 2013

(87) PCT Pub. No.: WO2012/147991

PCT Pub. Date: Nov. 1, 2012

(65) Prior Publication Data

US 2014/0050504 A1 Feb. 20, 2014

(30) Foreign Application Priority Data

Apr. 26, 2011 (JP) ..... 2011-097764

(51) Int. Cl.
*G03G 9/093* (2006.01)
*G03G 9/08* (2006.01)

(Continued)

(52) U.S. Cl.
CPC ..... *G03G 9/0827* (2013.01); *G03G 9/0804* (2013.01); *G03G 9/0806* (2013.01);
(Continued)

(58) Field of Classification Search
CPC ..... G03G 9/0819; G03G 9/0827; G03G 9/09716; G03G 9/0825; G03G 9/08708
USPC ..... 430/108.6, 108.7, 110.1, 110.3; 399/222
See application file for complete search history.

(56) References Cited

U.S. PATENT DOCUMENTS 4,950,573 A 8/1990 Yamaguchi et al.
5,710,965 A 1/1998 Nozawa et al.

(Continued)

FOREIGN PATENT DOCUMENTS

CN 101038452 9/2007
CN 102713763 10/2012

(Continued)

OTHER PUBLICATIONS

International Search Report Issued Jun. 5, 2012 in PCT/JP2012/061629 Filed Apr. 25, 2012.

(Continued)

*Primary Examiner* — Peter Vajda
(74) *Attorney, Agent, or Firm* — Oblon, McClelland, Maier & Neustadt, L.L.P.

(57) ABSTRACT

An electrostatic image developing toner including: toner base particles each including a binder resin and a colorant; and an external additive, wherein the toner base particles each have protrusions on a surface thereof, an average of lengths of long sides of the protrusions is 0.1 μm or more but less than 0.5 μm, a standard deviation of the lengths of the long sides of the protrusions is 0.2 or less, a coverage rate of the protrusions on the surface of each toner base particle is 10% to 90%, and the external additive includes an external additive (A) which is fine inorganic particles each containing silicone oil.

15 Claims, 5 Drawing Sheets

(51) Int. Cl.
*G03G 9/087* (2006.01)
*G03G 9/097* (2006.01)

(52) U.S. Cl.
CPC ..... *G03G9/0819* (2013.01); *G03G 9/0825* (2013.01); *G03G 9/08708* (2013.01); *G03G 9/09307* (2013.01); *G03G 9/09321* (2013.01); *G03G 9/09392* (2013.01); *G03G 9/09716* (2013.01)

(56) References Cited

U.S. PATENT DOCUMENTS

| | | | | |
|---|---|---|---|---|
| 5,770,342 | A | 6/1998 | Okae et al. | |
| 8,268,527 | B2 | 9/2012 | Kadota et al. | |
| 8,338,066 | B2 | 12/2012 | Nozaki et al. | |
| 8,518,625 | B2 | 8/2013 | Fukao et al. | |
| 2003/0190540 | A1* | 10/2003 | Shoshi et al. | 430/78 |
| 2005/0164114 | A1 | 7/2005 | Yagi et al. | |
| 2005/0196694 | A1 | 9/2005 | Yuasa et al. | |
| 2007/0141500 | A1 | 6/2007 | Sugimoto et al. | |
| 2008/0206665 | A1 | 8/2008 | Yuasa et al. | |
| 2008/0233496 | A1* | 9/2008 | Kotsugai et al. | 430/48 |
| 2009/0233211 | A1 | 9/2009 | Takahashi | |
| 2010/0055603 | A1 | 3/2010 | Nozaki et al. | |
| 2011/0053063 | A1 | 3/2011 | Kadota et al. | |
| 2011/0053071 | A1 | 3/2011 | Miki et al. | |
| 2011/0250533 | A1 | 10/2011 | Kadota et al. | |
| 2011/0287356 | A1 | 11/2011 | Fukao et al. | |
| 2012/0219321 | A1 | 8/2012 | Fukao et al. | |
| 2012/0237267 | A1 | 9/2012 | Fukao et al. | |
| 2012/0264048 | A1 | 10/2012 | Ishikawa et al. | |

FOREIGN PATENT DOCUMENTS

| | | | | | |
|---|---|---|---|---|---|
| JP | 07-114211 | | | 5/1995 | |
| JP | 09-258480 | | | 10/1997 | |
| JP | 2750853 | | | 2/1998 | |
| JP | 2838410 | | | 10/1998 | |
| JP | 2876898 | | | 1/1999 | |
| JP | 3155849 | | | 2/2001 | |
| JP | 2002-174926 | | | 6/2002 | |
| JP | 2003-202701 | | | 7/2003 | |
| JP | 2004-086131 | | | 3/2004 | |
| JP | 2005-284269 | | | 10/2005 | |
| JP | 2006-071994 | | | 3/2006 | |
| JP | 2006-184746 | | | 7/2006 | |
| JP | 2006-251267 | | | 9/2006 | |
| JP | 2008-090256 | | | 4/2008 | |
| JP | 2008-170901 | | | 7/2008 | |
| JP | 4181960 | | | 9/2008 | |
| JP | 2008-233430 | | | 10/2008 | |
| JP | 2008-268872 | | | 11/2008 | |
| RU | 2 125 968 | C1 | | 2/1999 | |
| WO | WO 2011/052794 | | * | 5/2011 | G03G 9/08 |
| WO | WO 2011/052794 | A1 | | 5/2011 | |

OTHER PUBLICATIONS

U.S. Appl. No. 14/112,407, filed Oct. 17, 2013, Ishikawa, et al.
Extended European Search Report issued Sep. 11, 2014 in Patent Application No. 12776825.7.
Office Action mailed Oct. 8, 2015, in co-pending U.S. Appl. No. 14/112,407.
Office Action issued Sep. 29, 2015, in Chinese Patent Application No. 201280031549, filed Apr. 25, 2012 w/attached English translation.

* cited by examiner

ELECTROSTATIC IMAGE DEVELOPING TONER, IMAGE FORMING APPARATUS, IMAGE FORMING METHOD, AND PROCESS CARTRIDGE

TECHNICAL FIELD

The present invention relates to an electrostatic image developing toner for developing a latent electrostatic image formed in an electrophotographic method, an electrostatic recording method and an electrostatic printing method; and an image forming apparatus, an image forming method, and a process cartridge using the electrostatic image developing toner.

BACKGROUND ART

Dry-process developing devices using a powdery developing agent have widely been employed in image forming apparatuses such as electronic copiers, printers and facsimiles, in which a latent electrostatic image formed on a latent image bearing member is visualized with a developer to obtain a recorded image.

In recent years, color image forming apparatuses using electrophotographic process have broadly been employed, and digitized images are easily available. Thus, it is required to make an image to be printed at higher definition. While studying higher resolution and gradation of an image, as an improvement of a toner which visualizes a latent image, it has been studied to further conglobate and minimize in particle size for forming the image at high definition. And, since in the toners produced by the pulverizing methods, their conglobation and minimization are limited, so-called polymerized toners produced by a suspension polymerization method, an emulsification polymerization method and a dispersion polymerization method capable of conglobtaining and minimizing in particle size have been being employed.

In the production method of polymerized toners, toner materials having relatively low resistance are localized in the vicinity of the surfaces of toner core particles. Thus, the formed polymerized toners have low chargeability to cause background smear. In addition, the polymerized toner has a small particle diameter and thus has increased adhesive force to members, thereby raising problems such as filming and a drop in transfer efficiency. Furthermore, the polymerized toner is highly spherical to cause cleaning failure.

In view of this, attempts have been made to modify the surfaces of toner core particles to solve the aforementioned problems. The method for surface modification is, for example, dry methods in which fine particles are made to adhere onto the toner surfaces by the action of mechanical impact, and wet methods in which a resin dispersing agent is added to a dispersion liquid containing toner particles dispersed in a solvent, wherein the resin of the resin dispersing agent is different from the resin forming the toner particles.

Regarding the dry methods, disclosed is a toner including toner base particles and fine particles embedded in the surfaces thereof, wherein the toner is produced by adding the fine particles to the toner base particles heated to a temperature near their softening point, followed by stirring and mixing (see PTL 1). Also, disclosed is a toner including fine resin particles and toner core particles which are covered with the fine resin particles by the action of mechanical impact (see PTL 2).

However, in these dry methods, the fine particles cannot be uniformly and sufficiently attached or adhered to the toner base particles and toner core particles. As a result, the fine particles are exfoliated from the toner base particles and toner core particles to cause problems such as filming and adhesion.

Regarding the wet methods, disclosed is a method in which the surfaces of toner core particles formed of first resin particles and a colorant are partially or totally covered with second resin particles (see PTL 3). However, according to this method, the toner core particles are covered with the second resin particles so sparsely and ununiformly that background smear and toner storage stability cannot be sufficiently improved, although cleanability is improved. In addition, degradation of transferability occurs.

Also, disclosed is a toner including toner core particles and convex portions with an average diameter of 100 nm to 500 nm which are provided on the surfaces of the toner core particles, wherein the toner core particles are covered with the convex portions at a coverage rate of 10% to 80% (see PTL 4). However, according to the production method described in Examples, the protrusions of the toner are not uniform in size, and thus the toner cannot solve problems such as background smear. The binder resin forming the convex portions has high polarity to greatly change depending on the environment and thus, is insufficient in improvement of heat resistance storage stability.

Also, disclosed is a method in which fine resin particles are added in advance to an aqueous phase for fusion to control the particle diameter (see PTL 5). However, in this method, the fine resin particles are incorporated into toner core particles, and as a result, the toner core particles cannot be covered with the fine resin particles in such an amount that heat resistance storage stability is improved.

Also, disclosed is a toner having a core-shell structure (see PTL 6), but in this toner, cores are totally covered with shell layers, leading to considerable degradation of fixing property.

In addition to the above-described surface modification, some attempts to solve these problems by appropriately selecting external additives have been made. In particular, there have been various proposals utilizing hydrophobicity and low surface energy of silicone oil.

For example, it is disclosed that qualities of both transfer and fixing are kept in a favorable balance by defining the silicone oil release rate of fine inorganic particles each containing silicone oil (see PTL 7). Also, there is disclosed fine silica particles treated with silicone oil and having two peaks in the particle size distribution thereof (see PTL 8). Also, it is disclosed to use as external additives aggregates of fine particles treated with silicone oil and fine inorganic particles (see PTL 9). Also, it is disclosed to use as external additives fine inorganic particles treated with silicone oil and fine inorganic particles treated with a silane coupling agent (see PTL 10). However, any of these methods is not sufficient to retain transferability and abrasion resistance for a long period of time in a wide range. Attachment of an excessive amount of an external additive would degrade fixability and also raise contamination of a released external additive.

CITATION LIST

Patent Literature

PTL 1: Japanese Patent (JP-B) No. 2838410
PTL 2: JP-B No. 2750853
PTL 3: Japanese Patent Application Laid-Open (JP-A) No. 2008-090256
PTL 4: JP-A No. 2008-233430
PTL 5: JP-A No. 2003-202701
PTL 6: JP-A No. 09-258480
PTL 7: JP-A No. 2002-174926

PTL 8: JP-B No. 4181960
PTL 9: JP-B No. 3155849
PTL 10: JP-B No. 2876898

SUMMARY OF INVENTION

Technical Problem

The present invention aims to solve the above existing problems and achieve the following objects. Specifically, an object of the present invention is to provide a electrostatic image developing toner which does not contaminate a charging unit, a developing unit, a photoconductor and an intermediate transfer member, which can form a high-quality image having a proper image density with much less background smear even after long-term repetitive printing, and which can stably form an image with high reproducibility on any recording medium without involving blur or spot due to scattering.

Solution to Problem

The present inventors conducted extensive studies to achieve the above objects. As a result, they have found that the problem to be solved relates closely to a combination of an external additive used and a surface profile of toner base particles as described below, and have completed the present invention. Specifically, in order for an external additive to supply silicone oil for a long period of time in a wide range, it is important to prevent the external additive from being released from toner base particles. Examples of measures to prevent the external additive from being easily released include the following two measures: increasing the attachment force between the external additive and the toner base particles; and decreasing the contact area between the toner and members of an image forming apparatus. Particularly in the former measure, it is better that the external additive is in contact with the toner base particles. The surface area of the toner base particles is preferably larger for attaching a certain amount of the external additive onto the toner base particles. As in the present invention, providing protrusions uniform in size on the surfaces of the toner base particles exhibits the surface modification effects sufficiently, and increases the surface area of the toner base particles so that the toner base particles can bear more external additive uniformly. The protrusions provided can reduce the contact area between the toner and the members of the image forming apparatus, making it possible to prevent the external additive from being released from the toner base particles. In addition, it is also possible to obtain other effects of, for example, preventing the toner from contaminating members, improving transfer rate, preventing cleaning failures, and preventing aggregation between toner particles. In this manner, remarkable effects can be obtained by combining toner base particles having protrusions uniform in size with an external additive treated with silicone oil.

The present invention is based on the above findings obtained by the present inventors. Means for solving the above problems are as follows.

An electrostatic image developing toner including:

toner base particles each including a binder resin and a colorant; and an external additive, wherein the toner base particles each have protrusions on a surface thereof, wherein an average of lengths of long sides of the protrusions is 0.1 μm or more but less than 0.5 μm, wherein a standard deviation of the lengths of the long sides of the protrusions is 0.2 or less, wherein a coverage rate of the protrusions on the surface of each toner base particle is 10% to 90%, and wherein the external additive includes an external additive (A) which is fine inorganic particles each containing silicone oil.

Advantageous Effects of Invention

The present invention can provide an electrostatic image developing toner which does not contaminate a charging unit, a developing unit, a photoconductor and an intermediate transfer member, which can form a high-quality image having a proper image density with much less background smear even after long-term repetitive printing, and which can stably form an image with high reproducibility on any recording medium without involving blur or spot due to scattering. This can solve the above existing problems and achieve the object.

The present invention contributes significantly to a field of an electrophotographic development.

DESCRIPTION OF EMBODIMENTS

Electrostatic Image Developing Toner

An electrostatic image developing toner of the present invention includes toner particles each containing at least a binder resin and a colorant, and an external additive, and, if necessary, further includes other components.

<Toner Base Particle>

The toner base particles each have protrusions on a surface thereof. The average of lengths of long sides of the protrusions is 0.1 μm or more but less than 0.5 μm. The standard deviation of the lengths of the long sides of the protrusions is 0.2 or less. The coverage rate of the protrusions on a surface of each toner base particle is 10% to 90%. Such protrusions existing on the surface of each toner core particle can provide a high-quality image.

Figure 8:
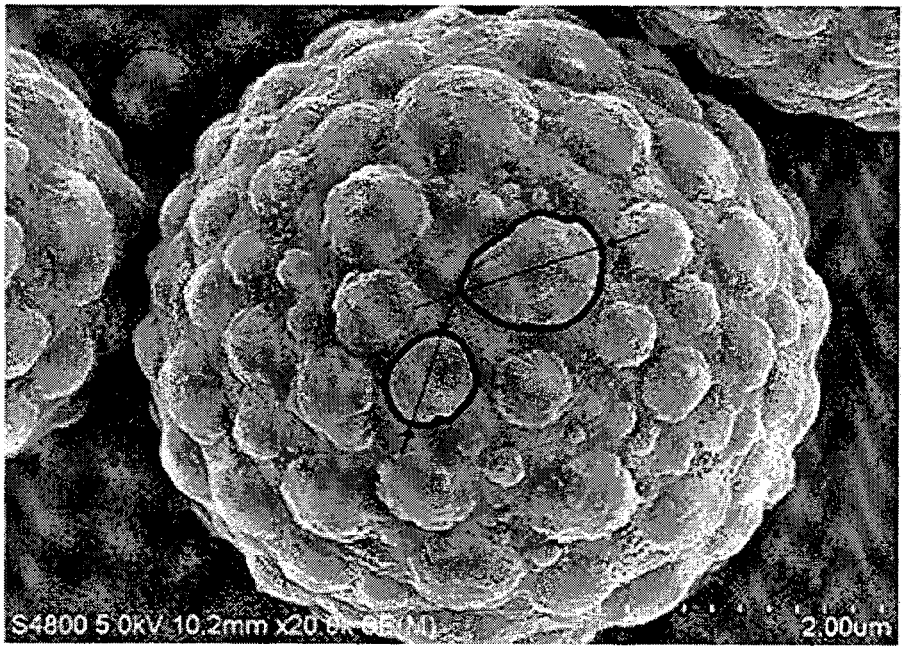
FIG. 8 is an explanatory view for a measuring method of long sides of protrusions of toner base particles of a toner of the present invention.

The term "long side of the protrusion" as used herein means the longest line segment among line segments connecting any two points on the boundary between a protrusion and a toner core particle (in FIG. 8, the term "long side of the protrusion" refers to the line segment ranging between the two points shown by two arrows). The average of the lengths of the long sides of the protrusions is 0.1 μm or more but less than 0.5 μm, preferably 0.1 μm to 0.3 μm. When it is 0.5 μm or more, the protrusions on the surface become sparse and the surface area of each toner base particle becomes small. As a result, the number of firmly supported external additives is small, which is not preferred. The standard deviation of the lengths of the long sides of the protrusions is 0.2 or less, preferably 0.1 or less. When it is more than 0.2, the size of the protrusions on the surface becomes ununiform and the surface area is not expected to increase, which is not preferred.

The coverage rate of the protrusions on a surface of each toner base particle is 10% to 90%, preferably 30% to 80%, more preferably 50% to 70%. When the coverage rate is less than 10%, surface modification effects; i.e., background smear-preventive effect and heat resistance storage stability, cannot be obtained easily and the number of firmly supported external additives is small. When the coverage rate is more than 90%, for example, fixing property is degraded and the number of firmly supported external additives is small. Needless to say, both cases are not preferred.

<Measurement Method of Long Side and Coverage Rate of Protrusions>

After beating aggregated toner base particles using, for example, HENSHEL MIXER, the toner base particles are observed under a scanning electron microscope (SEM). The obtained SEM image is used to measure lengths of long sides of the protrusions of each toner base particle and a coverage rate of the protrusions on each toner base particle.

Figure 1:
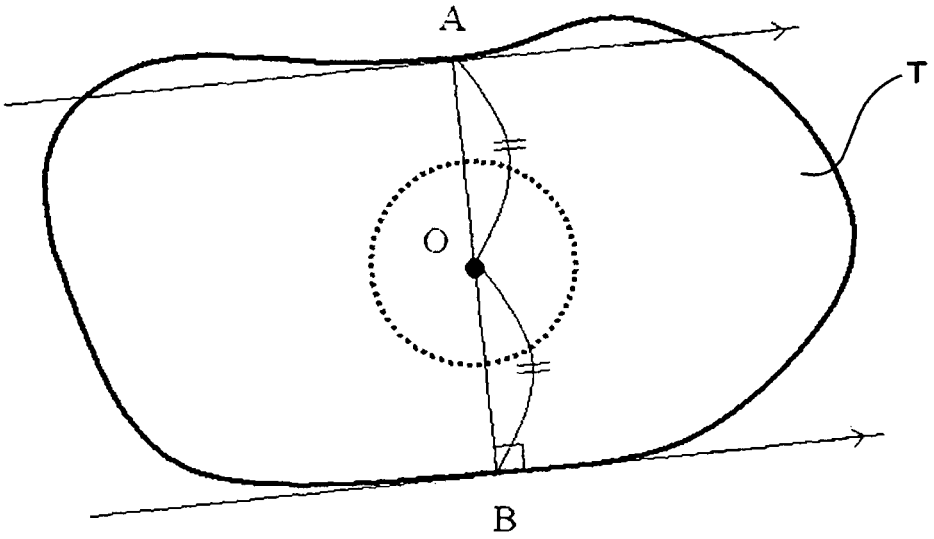
FIG. 1 is a sketch used for explaining a measurement method for a coverage rate of protrusions of toner base particles on a surface of a toner in the present invention.

Next, description will be given to the calculation methods for long sides and coverage rate of the protrusions described in Examples with reference to FIGS. 1 and 8.

First, the calculation method for coverage rate will be described. The shortest length between two parallel straight lines in contact with the toner particle is determined, and the contact points are defined as A and B. Then, the area of a circle having as a center the center O of the line segment AB and having as a diameter the length of the line segment AO is calculated. The total area of the protrusions contained in the circle is calculated to obtain a coverage rate of the protrusions on the toner particle (i.e., the total area of the protrusions/the area of the circle) (see FIG. 1). One hundred or more toner particles are calculated for coverage rate with the above method, and then an average of the obtained coverage rates is obtained.

The average length of the long sides is obtained as follows. Specifically, 100 or more toner base particles are selected for measurement, and at least 100 protrusions in total on the toner base particles are measured for length of the long side and the measured lengths are averaged (see FIG. 8). The area of the protrusions and the long side of the protrusions are measured with an image analysis-type particle size distribution analyzing software "MAC-VIEW" (product of Mountech Co., Ltd.). The measuring methods for the length of the long side of the protrusion and the area of the protrusion are not particularly limited and may be appropriately selected depending on the intended purpose.

In the present invention, the term "toner base particle" refers to toner core particles having protrusions thereon and containing a binder resin and a colorant as essential ingredients. Also, the term "toner particle" refers to toner base particles on which external additives have been supported.

The toner of the present invention may be obtained by adding external additives to toner base particles containing, as essential ingredients, a binder resin and a colorant, where the external additives are for improving properties such as flowability, developability and chargeability. Notably, the toner base particles may, if necessary, further contain other ingredients such as a releasing agent and/or a charge controlling agent.

<<Binder Resin>>

The binder resin is not particularly limited and may be appropriately selected depending on the intended purpose. Examples thereof include polyester resins, polyurethane resins, polyurea resins, epoxy resins, and vinyl resins. Hybrid resins formed of chemically-bonded different resins may be used. Reactive functional groups may be introduced to the ends or side chains of resins, and bonded together to elongate in the process of preparing a toner. One type of the binder resin may be used, but preferably a resin of which the toner particles are made is different from a resin of which the protrusions are made, in order to produce toner core particles having protrusions which have a uniform size.

<<Resin of which the Toner Core Particles are Made>>

Resin of which the colored particles are made is not particularly limited and may be appropriately selected depending on the intended purpose, so long as a resin at least part of which is dissolved in organic solvents. An acid value of the resin is not particularly limited and may be appropriately selected depending on the intended purpose, but is preferably 2 mgKOH/g to 24 mgKOH/g. When the acid value exceeds 24 mgKOH/g, the resin is likely to transfer to the aqueous phase, resulting in loss of the resin through the production process or easily degrading the dispersion stability of oil droplets. Also, the toner may come to absorb a larger amount of water, leading to degradation of chargeability and storageability under high-temperature, high-humidity environment. Whereas when the acid value is lower than 2 mgKOH/g, the polarity of the resin may become low, making it difficult to uniformly disperse the colorant with some polarity in the oil droplets.

The type of the resin is not particularly limited and may be appropriately selected depending on the intended purpose, however, when the toner core particles are used as a latent electrostatic image developing toner in electrophotography, the first resin is preferably a resin having a polyester skeleton from the viewpoint of obtaining good fixing property. The resin having a polyester skeleton includes polyester resins and block copolymers of polyesters and resins having other skeletons. Of these, polyester resins are preferably used since the obtained toner core particles have high uniformity.

The polyester resin is not particularly limited and may be appropriately selected depending on the intended purpose. Examples thereof include ring-opening polymers of lactones, polycondensates of hydroxycarboxylic acid, and polycondensates of polyols and polycarboxylic acids. Of these, polycondensates of polyols and polycarboxylic acids are preferred since a wide variety of polyesters can be formed.

The peak molecular weight of the polyester resin is not particularly limited and may be appropriately selected depending on the intended purpose. It is generally 1,000 to 30,000, preferably 1,500 to 10,000, more preferably 2,000 to 8,000. When the peak molecular weight is lower than 1,000, the heat resistance storage stability of the toner may be degraded. Whereas when the peak molecular weight exceeds 30,000, the low-temperature fixing property of the toner as latent electrostatic image developing toner may be degraded.

Also, the glass transition temperature of the polyester resin is not particularly limited and may be appropriately selected depending on the intended purpose. It is generally 40° C. to 80° C., preferably 50° C. to 70° C. When the toner core particles is covered with the protrusions as described in the present invention, storage of the toner core particles under high-temperature and high-humidity environment may cause plasticization of the resin in the protrusions with atmospheric moisture, to thereby decrease the glass transition temperature. Presumably, the toner or toner cartridge is transported under high-temperature, high-humidity environment. Thus, when the glass transition temperature is lower than 40° C., the obtained toner particles are deformed under application of a certain pressure or stick to each other. As a result, there is a possibility that the toner particles cannot behave as particles. When the glass transition temperature is higher than 80° C., the formed toner may be degraded in low-temperature fixing property when the toner particles are used as a latent electrostatic image developing toner. Needless to say, both cases are not preferred.

—Polyol—

Examples of polyols (1) include diols (1-1) and trihydric or higher polyols (1-2), with the diols (1-1) alone or a mixture containing the diols (1-1) and a small amount of the trihydric or higher polyols (1-2) being preferred.

Examples of diols (1-1) include alkylene glycols (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexanedimethanol and hydrogenated bisphenol A); bisphenols (e.g., bisphenol A, bisphenol F and bisphenol S); adducts of the above-listed alicyclic diols with alkylene oxides (e.g., ethylene oxide, propylene oxide and butylene oxide); 4,4'-dihydroxybiphenyls such as 3,3'-difluoro-4,4'-dihydroxybiphenyl; bis(hydroxyphenyl)alkanes such as bis(3-fluoro-4-hydroxyphenyl)methane, 1-phenyl-1,1-bis(3-fluoro-4-hydroxyphenyl)ethane, 2,2-bis(3-fluoro-4-hydroxyphenyl)propane, 2,2-bis(3,5-difluoro-4-hydroxyphenyl)propane (also known as tetrafluorobisphenol A) and 2,2-bis(3-hydroxyphenyl)-1,1,1,3,3,3-hexafluoropropane; bis(4-hydroxyphenyl)ethers such as bis(3-fluoro-4-hydroxyphenyl)ether; and adducts of the above-listed bisphenols with alkylene oxides (e.g., ethylene oxide, propylene oxide and butylene oxide).

Of these, preferred are C2 to C12 alkylene glycols and alkylene oxide adducts of bisphenols. Particularly preferred are combinations of alkylene oxide adducts of bisphenols and C2 to C12 alkylene glycols.

Examples of the trihydric or higher polyols (1-2) include trihydric to octahydric or higher aliphatic polyalcohols (e.g., glycerin, trimethylolethane, trimethylolpropane, pentaerythritol and sorbitol); trihydric or higher phenols (e.g., trisphenol PA, phenol novolac and cresol novolac); and alkylene oxide adducts of the above trihydric or higher polyphenols.

—Polycarboxylic Acid—

Examples of polycarboxylic acids (2) include dicarboxylic acids (2-1) and trivalent or higher polycarboxylic acids (2-2), with the dicarboxylic acids (2-1) alone or a mixture containing the dicarboxylic acids (2-1) and a small amount of the trivalent or higher polycarboxylic acids (2-2) being preferred.

Examples of dicarboxylic acids (2-1) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acid), 3-fluoroisophthalic acid, 2-fluoroisophthalic acid, 2-fluoroterephthalic acid, 2,4,5,6-tetrafluoroisophthalic acid, 2,3,5,6-tetrafluoroterephthalic acid, 5-trifluoromethylisophthalic acid, 2,2-bis(4-carboxyphenyl)hexafluoropropane, 2,2-bis(3-carboxyphenyl)hexafluoropropane, 2,2'-bis(trifluoromethyl)-4,4'-biphenyldicarboxylic acid, 3,3'-bis(trifluoromethyl)-4,4'-biphenyldicarboxylic acid, 2,2'-bis(trifluoromethyl)-3,3'-biphenyldicarboxylic acid and hexafluoroisopropylidenediphthalic anhydride. Of these, preferred are C4 to C20 alkenylenedicarboxylic acids and C8 to C20 aromatic dicarboxylic acids.

Examples of trivalent or higher polycarboxylic acids (2-2) include C9 to C20 aromatic polycarboxylic acids (e.g., trimellitic acid and pyromellitic acid). Notably, polycarboxylic acids (2) reacted with polyols (1) may be acid anhydrides or lower alkyl esters (e.g., methyl ester, ethyl ester and isopropyl ester) of the above carboxylic acids.

The ratio between polyol and polycarboxylic acid is generally 1/2 to 2/1, preferably 1/1.5 to 1.5/1, more preferably 1/1.3 to 1.3/1, in terms of the equivalent ratio [OH]/[COOH] of the hydroxyl group [OH] to the carboxyl group [COOH].

<<Modified Resin>>

In order for the toner particles to have an increased mechanical strength and, when the colored resin particles are used as a latent electrostatic image developing toner, further involve no hot offset upon fixing, a modified resin containing an end isocyanate group may be dissolved in the oil phase for producing the toner particles. The method for producing the modified resin is not particularly limited and includes a method in which an isocyanate group-containing monomer is used for polymerization reaction to obtain an isocyanate group-containing resin; and a method in which a resin having an active hydrogen-containing group at its end is obtained through polymerization and then reacted with polyisocyanate to obtain a polymer containing an isocyanate group at its end. The latter method is preferred from the viewpoint of satisfactorily introducing an isocyanate group into the end of the polymer. Examples of the active hydrogen-containing group include a hydroxyl group (i.e., an alcoholic hydroxyl group and a phenolic hydroxyl group), an amino group, a carboxyl group and a mercapto group, with an alcoholic hydroxyl group being preferred. Considering uniformity of particles, the skeleton of the modified resin is preferably the same as that of a resin dissolvable in the organic solvent. The resin preferably has a polyester skeleton. In one employable method for producing a polyester having an alcoholic hydroxyl group at its end, polycondensation reaction is performed between a polyol having more functional groups (i.e., hydroxyl groups) and a polycarboxylic acid having less functional groups (i.e., carboxyl groups).

<<Amine Compound>>

In the process of dispersing the oil phase in the aqueous phase to form particles, some isocyanate groups of the modified resin are hydrolyzed into amino groups, which are then reacted with unreacted isocyanate groups to allow elongation reaction to proceed. Also, an amine compound may be used in combination to perform elongation reaction and introduce crosslinked points as well as the above reaction. The amine compound (B) is not particularly limited and includes diamines (B1), trivalent or higher polyamines (B2), aminoalcohols (B3), aminomercaptans (B4), amino acids (B5) and amino-blocked compounds (B6) obtained by blocking the amino group of B1 to B5.

The diamine (B1) includes aromatic diamines (e.g., phenylene diamine, diethyltoluene diamine, 4,4'-diaminodiphenylmethane, tetrafluoro-p-xylylenediamine and tetrafluoro-p-phenylenediamine); alicyclic diamines (e.g., 4,4'-diamino-3,3'-dimethyldicyclohexylmethane, diaminecyclohexane and isophorondiamine); and aliphatic diamines (e.g., ethylenediamine, tetramethylenediamine, hexamethylenediamine, dodecafluorohexylenediamine and tetracosafluorododecylenediamine).

The trivalent or higher polyamine (B2) includes diethylenetriamine and triethylenetetramine.

The aminoalcohol (B3) includes ethanolamine and hydroxyethylaniline. The aminomercaptan (B4) includes aminoethylmercaptan and aminopropylmercaptan. The amino acid (B5) includes aminopropionic acid and aminocaproic acid.

The amino-blocked compound (B6) obtained by blocking the amino group of B1 to B5 includes oxazolidine compounds and ketimine compounds derived from the amines B1 to B5 and ketones (e.g., acetone, methyl ethyl ketone and methyl isobutyl ketone).

Among these amines (B), preferred are B1 and a mixture containing B1 and a small amount of B2.

The amount of the amine (B) is not particularly limited and may be appropriately selected depending on the intended purpose. The number of amino groups [NHx] in the amine (B) is four or less times, preferably twice or less times, more preferably 1.5 or less times, further preferably 1.2 or less times, the number of isocyanate groups [NCO] in the isocyanate group-containing prepolymer (A). When the number of amino groups [NHx] in the amine (B) is preferably more than four times the number of isocyanate groups [NCO] in the isocyanate group-containing prepolymer (A), excessive amino groups disadvantageously block isocyanate groups to prevent the elongation reaction of the modified resin. As a result, the polyester is decreased in molecular weight, resulting in degradation of hot offset resistance of the toner.

<<Organic Solvent>>

The organic solvent is not particularly limited and may be appropriately selected depending on the intended purpose, but is preferably a volatile organic solvent having a boiling point lower than 100° C. from the viewpoint of easily removing the solvent. The organic solvent includes toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. These may be used alone or in combination. When the resin to be dissolved or dispersed in the organic solvent has a polyester skeleton, preferably used are ester solvents (e.g., methyl acetate, ethyl acetate and butyl acetate) or ketone solvents (e.g., methyl ethyl ketone and methyl isobutyl ketone) since these solvents have high dissolution capability to the resin. Among them, methyl acetate, ethyl acetate and methyl ethyl ketone are particularly preferred since these can be removed more easily.

<Aqueous Medium>

The aqueous medium may be water alone or a mixture of water and a water-miscible solvent. The water-miscible solvent includes alcohols (e.g., methanol, isopropanol and ethylene glycol), dimethylformamide, tetrahydrofuran, cellosolves (e.g., methyl cellosolve (registered trademark)) and lower ketones (e.g., acetone and methyl ethyl ketone).

<<Surfactant>>

A surfactant may be used for dispersing the oil phase in the aqueous medium to form liquid droplets.

The surfactant is not particularly limited and may be appropriately selected depending on the intended purpose. Examples thereof include anionic surfactants such as alkylbenzenesulfonic acid salts, α-olefin sulfonic acid salts and phosphoric acid esters; cationic surfactants such as amine salts (e.g., alkyl amine salts, aminoalcohol fatty acid derivatives, polyamine fatty acid derivatives and imidazoline), and quaternary ammonium salts (e.g., alkyltrimethylammonium salts, dialkyl dimethylammonium salts, alkyl dimethyl benzyl ammonium salts, pyridinium salts, alkyl isoquinolinium salts and benzethonium chloride); nonionic surfactants such as fatty acid amide derivatives and polyhydric alcohol derivatives; and amphoteric surfactants such as alanine, dodecyldi(aminoethyl)glycine, di(octylaminoethyl)glycine and N-alkyl-N,N-dimethylammonium betaine. Also, a fluoroalkyl group-containing surfactant can exhibit its dispersing effects even in a very small amount.

A fluoroalkyl group-containing anionic surfactant suitably used includes fluoroalkyl carboxylic acids having 2 to 10 carbon atoms and metal salts thereof, disodium perfluorooctanesulfonylglutamate, sodium 3-[ω-fluoroalkyl(C6 to C11)oxy)-1-alkyl(C3 or C4) sulfonates, sodium 3-[ω-fluoroalkanoyl(C6 to C8)-N-ethylamino]-1-propanesulfonates, fluoroalkyl(C11 to C20) carboxylic acids and metal salts thereof, perfluoroalkylcarboxylic acids (C7 to C13) and metal salts thereof, perfluoroalkyl(C4 to C12)sulfonates and metal salts thereof, perfluorooctanesulfonic acid diethanol amide, N-propyl-N-(2-hydroxyethyl)perfluorooctanesulfone amide, perfluoroalkyl(C6 to C10)sulfonamide propyltrimethylammonium salts, salts of perfluoroalkyl(C6 to C10)-N-ethylsulfonylglycin and monoperfluoroalkyl(C6 to C16) ethylphosphates. The cationic surfactant includes aliphatic primary, secondary or tertiary amine acid containing a fluoroalkyl group, aliphatic quaternary ammonium salts (e.g., perfluoroalkyl(C6 to C10) sulfonamide propyltrimethylammonium salts), benzalkonium salts, benzethonium chloride, pyridinium salts and imidazolinium salts.

<<Inorganic Dispersing Agent>>

The dissolution or dispersion product of the toner composition may be dispersed in the aqueous medium in the presence of an inorganic dispersing agent or fine resin particles.

The inorganic dispersing agent includes tricalcium phosphate, calcium carbonate, titanium oxide, colloidal silica and hydroxyapatite. Use of such inorganic dispersing agent is preferred since a sharp particle size distribution and a stable dispersion state can be attained.

<<Protective Colloid>>

A polymeric protective colloid may be used in the aqueous medium to stabilize dispersed liquid droplets.

For example, acids (e.g., acrylic acid, methacrylic acid, α-cyanoacrylic acid, α-cyanomethacrylic acid, itaconic acid, crotonic acid, fumaric acid, maleic acid and maleic anhydride); hydroxyl group-containing (meth)acrylic monomers (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerin monoacrylic acid esters, glycerin monomethacrylic acid esters, N-methylolacrylamide and N-methylolmethacrylamide), vinyl alcohol and ethers thereof (e.g., vinyl methyl ether, vinyl ethyl ether and vinyl propyl ether), esters formed between vinyl alcohol and a carboxyl group-containing compound (e.g., vinyl acetate, vinyl propionate and vinyl butyrate); acrylamide, methacrylamide, diacetone acrylamide and methylol compounds thereof, acid chlorides (e.g., acrylic acid chloride and methacrylic acid chloride); homopolymers or copolymers of nitrogen-containing compounds and nitrogen-containing heterocyclic compounds (e.g., vinyl pyridine, vinyl pyrrolidone, vinyl imidazole and ethyleneimine); polyoxyethylenes (e.g., polyoxyethylene, polyoxypropylene, polyoxyethylene alkyl amines, polyoxypropylene alkyl amines, polyoxyethylene alkyl amides, polyoxypropylene alkyl amides, polyoxyethylene nonylphenyl ethers, polyoxyethylene laurylphenyl ethers, polyoxyethylene stearylphenyl esters and polyoxyethylene nonylphenyl esters); and celluloses (e.g., methyl cellulose, hydroxyethyl cellulose and hydroxypropyl cellulose) can be used.

When an acid- or alkali-soluble compound (e.g., calcium phosphate) is used as a dispersion stabilizer, the calcium phosphate used is dissolved with an acid (e.g., hydrochloric acid), followed by washing with water, to thereby remove it from the formed fine particles (toner particles). Also, the calcium phosphate may be removed through enzymatic decomposition. Alternatively, the dispersing agent used may remain on the surfaces of the toner particles. But, the dispersing agent is preferably removed through washing after elongation and/or crosslinking reaction in terms of chargeability of the formed toner.

<<Colorant>>

The colorant is not particularly limited and known dyes and pigments can be used. Examples thereof include carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian, emerald green, pigment green B, naphthol green B, green gold, acid green lake, malachite green lake, phthalocyanine green, anthraquinon green, titanium oxide, zinc flower, lithopone and mixtures thereof.

—Colorant Formed into Masterbatch—

The colorant may be mixed with a resin to form a masterbatch.

Examples of the binder resin which is used for producing a masterbatch or which is kneaded together with a masterbatch include the above-described modified or unmodified polyester resins; styrene polymers and substituted products thereof (e.g., polystyrenes, poly-p-chlorostyrenes and polyvinyltoluenes); styrene copolymers (e.g., styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers); polymethyl methacrylates; polybutyl methacrylates; polyvinyl chlorides; polyvinyl acetates; polyethylenes; polypropylenes, polyesters; epoxy resins; epoxy polyol resins; polyurethanes; polyamides; polyvinyl butyrals; polyacrylic acid resins; rosin; modified rosin; terpene resins; aliphatic or alicyclic hydrocarbon resins; aromatic petroleum resins; chlorinated paraffins; and paraffin waxes. These may be used alone or in combination.

<<Preparation Method of Masterbatch>>

The masterbatch can be prepared by mixing/kneading a colorant with a resin for use in a masterbatch through application of high shearing force. Also, an organic solvent may be used for improving mixing between these materials. Further, the flashing method, in which an aqueous paste containing a colorant is mixed/kneaded with a resin and an organic solvent and then the colorant is transferred to the resin to remove water and the organic solvent, is preferably used, since a wet cake of the colorant can be directly used (i.e., no drying is required to be performed). In this mixing/kneading the colorant with the resin, a high-shearing disperser (e.g., three-roll mill) is preferably used.

<External Additive>

The external additive contains an external additive (A) which is made of fine inorganic particles containing silicone oil. The external additive may contain further external additives other than the external additive (A). Example thereof includes an external additive (B) which contains no silicone oil. The external additive (B) includes fine inorganic or organic particles containing no silicone oil.

<<Fine Inorganic Particles>>

The fine inorganic particles are not particularly limited and may be appropriately selected depending on the intended purpose. Examples thereof includes silica, alumina, titanium oxide, barium titanate, magnesium titanate, calcium titanate, strontium titanate, iron oxide, copper oxide, zinc oxide, tin oxide, silica sand, clay, mica, wollastonite, diatom earth, chromium oxide, cerium oxide, red oxide, antimony trioxide, magnesium oxide, zirconium oxide, barium sulfate, barium carbonate, silicon carbide, silicon nitride.

Among these, silica and titanium oxide are preferable.

<<Fine Organic Particles>>

The fine organic particles are not particularly limited and may be appropriately selected depending on the intended purpose. Examples thereof include styrene polymers and substituted styrene polymers such as polystyrene, poly-p-chlorostyrene, polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl-α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethanes, polyamides, polyvinyl butyrals, polyacrylic resins, rosins, modified rosins, terpene resins, aliphatic or alicyclic hydrocarbon resins, aromatic petroleum resins, chlorinated paraffin, paraffin waxes. These may be used alone or in combination.

<<Hydrophobization Treatment>>

The fine inorganic particles may be hydrophobized. For example, a method for hydrophobizing the fine inorganic particles includes a method in which the fine inorganic particles are chemically treated with organic silicon compounds which can react with the fine inorganic particles or to which the fine inorganic particles can be physically adsorbed. A method is preferably used in which the fine inorganic particles are oxidized by a halogenated metal in a vapor phase and then treated with organic silicon compounds.

The organic silicon compounds are not particularly limited and may be appropriately selected depending on the intended purpose. Examples thereof include hexamethylene disilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, ρ-chloroethyltrichlorosilane, chloromethyldimethylchlorosilane, triorganosilylmercaptane, trimethylsilylmercaptane, triorganosilyl acrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, dimethylpolysiloxane having 2 to 12 siloxane units per one molecule and, at each ends, one hydroxy group connecting with silicon atom.

Untreated fine inorganic particles can be hydrophobized using nitrogen-containing silane coupling agents. Preferable are the fine inorganic particles which have been treated with the nitrogen-containing silane coupling agents as external additives charged to the opposite polarity to that of the toner particles. Examples of the nitrogen-containing silane coupling agents include aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyltrimethoxysilane, dibutylaminopropyldimethoxysilane, dibutylaminopropylmonomethoxysilane, dimethylaminophenyltriethoxysilane, trimethoxysilyl-γ-propylphenylamine, trimethoxysilyl-γ-propylbenzylamine, trimethoxysilyl-γ-propylpiperidine, trimethoxysilyl-γ-propylmorphorine, and trimethoxysilyl-γ-propylimidazole. These may be used alone or in combination.

Fine inorganic particles with or without hydrophobization treatment are treated with a silicone oil to use as the external additives (A).

Examples of the silicone oil include dimethylsilicone oil, methylphenylsilicone oil, chlorophenylsilicone oil, methylhydrogensilicone oil, alkyl-modified silicone oil, fluorine-modified silicone oil, polyether-modified silicone oil, alcohol-modified silicone oil, amino-modified silicone oil, epoxy-modified silicone oil, epoxy/polyether-modified silicone oil, phenol-modified silicone oil, carboxyl-modified silicone oil, mercapto-modified silicone oil, acrylic-modified silicone oil, methacrylic-modified silicone oil, and α-methylstyrene-modified silicone oil.

These may be used alone or in combination.

A method for treating the fine inorganic particles with the silicone oil includes a method in which the fine inorganic particles are dried in an oven which has been heated at several hundred degrees Celsius to fully remove water therefrom; and are uniformly contacted with the silicone oil so that the silicone oil is made to attach onto a surface of the fine inorganic particles.

A method for attaching the silicone oil onto the surface of the fine inorganic particles includes the following methods: (1) sufficiently mixing the fine inorganic particles with the silicone oil using a mixer such as a rotating blade while keeping the fine inorganic particles in powder form; or (2) dissolving the silicone oil in a solvent having relatively low boiling point and capable of being diluted with the silicone oil, immersing the fine inorganic particles into the resultant solution, and then drying the solvent to remove it therefrom.

When the silicone oil has a high viscosity, it is preferable to use the latter method.

The fine inorganic particles onto which the silicone oil has been attached are then heated in an oven which has been heated to a temperature from 100° C. to several hundred degrees Celsius (generally about 400° C.). Through this heat treatment, siloxane bonds can be formed between a metal and the silicone oil via hydroxyl groups on the surface of the fine inorganic particles, and/or the silicone oil itself can be further polymerized and crosslinked.

A catalyst such as acids, alkalis, and metal salts such as zinc octylate, tin octylate and dibutyl tin dilaurate may have been previously added to the silicone oil to accelerate the reaction.

The external additives (A) may have been previously treated with hydrophobizating agents such as silane coupling agents before the silicone oil treatment.

The fine inorganic particles which have been subjected to the hydrophobization treatment adsorb more silicone oil than the fine inorganic particles which have not been subjected to the hydrophobization treatment.

<<Average Particle Diameter of Fine Inorganic Particles>>

The average particle diameter of primary particles of the external additives (A) is not particularly limited and may be appropriately selected depending on the intended purpose, but is 100 nm at the largest, preferably 70 nm or less. When the average particle diameter is larger than 100 nm, the surface area of the fine inorganic particles becomes small, and thus the fine inorganic particles can support only a small volume of the silicone oil, which prevents the silicone oil from exerting the effects sufficiently even though the exfoliation rate is within the above-mentioned range. In addition, such too large external additive (A) does ununiformly damage to the photoconductor surface, which is not preferred. Here, the average particle diameter is a number average particle diameter.

The average diameter can be measured by a particle size distribution analyzer, which measures a particle diameter utilizing dynamic light scattering. Examples thereof include DLS-700 (product of Otsuka Electronics Co., Ltd.) and Coulter N4 (product of Coulter Electronics, Inc.). However, since it is difficult to dissociate the secondary aggregated fine particles after the silicone oil treatment, preferable is directly determining the particle diameter using a photomicrograph taken with a scanning electron microscope or a transmission electron microscope. More preferable is observing the external additives on the surface of the toner particles using a FE-SEM (field emission type scanning electron microscope) at a magnification of 100,000.

In this case, it is preferable that at least 100 fine inorganic particles are observed to calculate an average length of major axes thereof. When the external additives are aggregated on the surfaces of the toner particles, the length of the major axis of each primary particle constituting an aggregation is measured.

<<Method for External Adding>>

The external additives are added to the toner base particles and mixed therewith using conventional mixers for mixing powders. Examples of the mixers include a mixer having a jacket to control the inside temperature thereof. In order to change a loading applied to the external additives, a rotation number and rolling speed of the mixers, and mixing time and temperature may be changed. For example, at first a high loading may be applied and then a relatively low loading may be applied, and vice versa. Examples of the usable mixers include a locking mixer, LOEDIGE MIXER, NAUTOR MIXER, and HENSHEL MIXER.

<<Amount of External Additives>>

Toner properties can be controlled depending on an amount of the external additives.

The amount of the external additives (A) added is not particularly limited and may be appropriately selected depending on the intended purpose, but preferably 1.0% by mass to 5.0% by mass, more preferably 1.5% by mass to 4.5% by mass, particularly preferably 2.0% by mass to 4.0% by mass relative to the toner. When the amount is less than 1.0% by mass, the amount of the silicone oil contained in the toner particles is too small to keep transferability and abrasion resistance over a long time. Also, the toner may be deteriorated in storageability. When the amount exceeds 5.0% by mass, the toner properties may considerably change over time. In addition, members may be contaminated with exfoliated external additives due to low adhesion strength with the toner particles. Needless to say, both cases are not preferred. When two or more types of the external additives (A) are added, the total amount of the external additives (A) should be in the foregoing range.

In addition to the external additive (A), the external additive (B) may be added which is made of fine inorganic or organic particles containing no silicone oil.

The amount of the external additives (B) added is not particularly limited and may be appropriately selected depending on the intended purpose, but preferably 5.0% by mass or less, more preferably 4.0% by mass or less, particularly preferably 3.0% by mass or less relative to the toner base particles. When the amount exceeds 5.0% by mass, the toner properties may considerably change over time. In addition, exfoliated external additives may contaminate members because the external additive (B) cannot firmly attach to the toner particles and prevents the external additives (A) from firmly attaching to the toner particles. Needless to say, both cases are not preferred. The amount of the external additive (B) added is preferably equivalent to or less than that of the external additive (A) in order to allow the silicone oil to exert the effects sufficiently.

<<Releasing Agent>>

The toner particles may contain a releasing agent in order to have an increased releasing property during fixing. The releasing agent may be dispersed in the organic solvent in advance in a production process of the toner.

The releasing agent is not particularly limited and may be appropriately selected depending on the intended purpose. For example, materials such as wax and silicone oil may be used that exhibit a sufficiently low viscosity when heated during the fixing process and that are difficult to be compatible or swelled with other toner particles materials on the fixing member surface. Considering the storage stability of the toner particles themselves, preferably used is wax that generally exists as a solid in the toner particles during storage.

The wax includes long-chain hydrocarbons and carbonyl group-containing waxes. Examples of the long-chain hydrocarbon include polyolefin waxes (e.g., polyethylene wax and polypropylene wax); petroleum waxes (e.g., paraffin waxes, SASOL wax and microcrystalline waxes); and Fischer-Tropsch waxes.

Examples of the carbonyl group-containing wax include polyalkanoic acid esters (e.g., carnauba wax, montan wax, trimethylolpropane tribehenate, pentaerythritol tetrabehenate, pentaerythritol diacetatedibehenate, glycerine tribehenate and 1,18-octadecanediol distearate); polyalkanol esters (e.g., tristearyl trimellitate and distearyl malleate); polyalkanoic acid amides (e.g., ethylenediamine dibehenylamide); polyalkylamides (e.g., trimellitic acid tristearylamide); and dialkyl ketones (e.g., distearyl ketone).

Of these, long-chain hydrocarbons are preferred since they exhibit better releasing property. Furthermore, the long-chain hydrocarbons may be used in combination with the carbonyl group-containing waxes. The amount of the releasing agent contained in the toner particles is 2% by mass to 25% by mass, preferably 3% by mass to 20% by mass, more preferably 4% by mass to 15% by mass. When it is less than 2% by mass, the releasing property of the formed toner cannot be obtained during fixing. Whereas when it is more than 25% by mass, the formed toner particles may be degraded in mechanical strength.

<<Charge Controlling Agent>>

The toner particles may contain a charge controlling agent. The charge controlling agent may be dissolved or dispersed in the organic solvent in advance in a production process of the toner.

The charge controlling agent is not particularly limited and may be any known charge controlling agent. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives. Specific examples include nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (these products are of ORIENT CHEMICAL INDUSTRIES CO., LTD), quaternary ammonium salt molybdenum complex TP-302 and TP-415 (these products are of Hodogaya Chemical Co., Ltd.), quaternary ammonium salt COPY CHARGE PSY VP 2038, triphenylmethane derivative COPY BLUE PR, quaternary ammonium salt COPY CHARGE NEG VP2036 and COPY CHARGE NX VP434 (these products are of Hoechst AG), LRA-901 and boron complex LR-147 (these products are of Japan Carlit Co., Ltd.), copper phthalocyanine, perylene, quinacridone, azo pigments, and polymeric compounds having, a functional group such as a sulfonic acid group, carboxyl group, or quaternary ammonium salt.

The amount of the charge controlling agent contained in the toner particles is not particularly limited so long as the charge controlling agent can exhibit its performances without degrading the fixing property of the toner. The amount thereof is preferably 0.5% by mass to 5% by mass, more preferably 0.8% by mass to 3% by mass.

<Production Method of Toner Base Particles>

The production method of toner base particles is not particularly limited and may be appropriately selected depending on the intended purpose. Examples thereof include known wet process granulation methods such as a dissolution suspension method, a suspension polymerization method, and an emulsification aggregation method, and pulverizing methods. Among these, a dissolution suspension method and an emulsification aggregation method are preferable in terms of easiness for controlling the particle diameter and shape of the toner.

After the toner base particles as a core have been produced by a known emulsification aggregation method or suspension polymerization method, fine resin particles are added to the reaction system, so that the fine resin particles are attached to or fused with the surfaces of the toner core particles. Here, the reaction system may be heated to promote attachment or fusion of the fine resin particles. Also, a metal salt may be added.

<Fine Resin Particles>

The fine resin particles used in production of the protrusions can be the fine resin particles dispersed in the aqueous medium before use. The resin of the fine resin particles includes vinyl resins, polyesters, polyurethanes, polyureas and epoxy resins. Of these, vinyl resins are preferred from the viewpoint of easily obtaining the fine resin particles dispersed in the aqueous medium. The method for preparing aqueous dispersoids of vinyl fine resin particles is not particularly limited. Examples thereof include known polymerization methods such as an emulsification aggregation method, a suspension polymerization method and a dispersion polymerization method. Of these, an emulsification aggregation method is particularly preferred from the viewpoint of easily obtaining particles having a particle diameter suitable for the present invention.

The vinyl fine resin particles contain a vinyl resin obtained through polymerization of a monomer mixture containing at least a styrene monomer.

In order for the toner particles obtained in the present invention to be used as charged functional particles like latent electrostatic image developing toner particles, the toner base particles each preferably have an easily chargeable surface. Therefore, in the monomer mixture, the amount of the styrene monomer, which has electron orbitals where electrons can stably travel as can be seen in aromatic ring structures is 50% by mass to 100% by mass, preferably 80% by mass to 100% by mass, more preferably 95% by mass to 100% by mass. When the amount of the styrene monomer is less than 50% by mass, the obtained toner base particles are poor in chargeability, which may impose limitation on applications of the toner base particles.

Here, the styrene monomer refers to an aromatic compound having a vinyl polymerizable functional group. The vinyl polymerizable functional group includes a vinyl group, an isopropenyl group, an allyl group, an acryloyl group and a methacryloyl group.

Specific examples of the styrene monomer include styrene, α-methylstyrene, 4-methylstyrene, 4-ethylstyrene, 4-tert-butylstyrene, 4-methoxystyrene, 4-ethoxystyrene, 4-carboxystyrene and metal salts thereof; 4-styrenesulfonic acid and metal salts thereof, 1-vinylnaphthalene, 2-vinylnaphthalene, allylbenzene, phenoxyalkylene glycol acrylate, phenoxyalkylene glycol methacrylate, phenoxypolyalkylene glycol acrylates and phenoxypolyalkylene glycol methacrylates. Of these, styrene is preferably used since it is easily available, and has excellent reactivity and high chargeability.

Also, in the monomer mixture, the amount of an acid monomer used in the vinyl resin is 0% by mass to 7% by mass, preferably 0% by mass to 4% by mass, more preferably 0% by mass; i.e., no acid monomer is contained. When the amount thereof exceeds 7% by mass, the obtained vinyl fine resin particles themselves have high dispersion stability. Thus, when such vinyl fine resin particles are added to the dispersion liquid containing oil droplets dispersed in the aqueous phase, they are difficult to attach thereonto at ambient temperature. Or, even when the vinyl fine resin particles have been attached thereonto, they tend to be exfoliated through the process of solvent removal, washing, drying and treating with external additives. Whereas when the amount thereof is 4% by mass or less, the obtained toner base particles less changes in chargeability depending on the working environment.

Here, the acid monomer refers to a compound having an acid group in addition to the vinyl polymerizable functional group. The acid group includes carboxylic acid, sulfonic acid and phosphoric acid.

The acid monomer includes carboxyl group-containing vinyl monomers and salts thereof (e.g., (meth)acrylic acid, maleic acid or maleic anhydride, monoalkyl maleates, fumaric acid, monoalkyl fumarates, crotonic acid, itaconic acid, monoalkyl itaconate, glycol itaconate monoethers, citraconic acid, monoalkyl citraconates and cinnamic acid), sulfonic acid group-containing vinyl monomers and salts thereof, vinyl-based sulfuric acid monoesters and salts thereof, and phosphoric acid group-containing vinyl monomers and salts thereof. Of these, preferred are (meth)acrylic acid, maleic acid or maleic anhydride, monoalkyl maleates, fumaric acid and monoalkyl fumarates.

Also, a monomer having an ethylene oxide (EO) chain may be used for controlling compatibility to the toner core particles. Examples of the monomer having an ethylene oxide (EO) chain include phenoxy alkylene glycol acrylate, phenoxy alkylene glycol methacrylate, phenoxy polyalkylene glycol acrylate, phenoxy polyalkylene glycol methacrylate. The amount of the monomer having an ethylene oxide (EO) chain used is not particularly limited and may be appropriately selected depending on the intended purpose, but preferably 10% by mass or less, more preferably 5% by mass or less, further preferably 2% by mass or less, relative to the total amount of the monomers. When the amount thereof exceeds 10% by mass, an increased number of polar groups on the toner base particle surface considerably degrade charge stability to the environment. In addition, the compatibility to the toner core particles becomes too high, the embedment rate of protrusions becomes high, and thus the coverage rate of the protrusions becomes low, resulting in that the surface modification cannot exert a sufficient effect. Needless to say, both cases are not preferred.

Also, a monomer having an ester bond (e.g., 2-acryloyloxyethyl succinate or 2-methacryloyloxyethyl phthalate) may simultaneously be used for controlling compatibility of the toner core particles. In this case, the amount of such a monomer used is preferably 10% by mass or less, more preferably 5% by mass or less, further preferably 2% by mass or less, relative to the total amount of the monomers. When the amount thereof is more than 10%, an increased number of polar groups on the toner base particle surface considerably degrade charge stability to the environment, which is not preferred. In addition, the compatibility to the toner core particles becomes too high, the embedment rate of protrusions becomes high, and thus the coverage rate of the protrusions becomes low, resulting in that the surface modification cannot exert a sufficient effect. Needless to say, both cases are not preferred.

The method for obtaining the vinyl fine resin particles is not particularly limited and may be appropriately selected depending on the intended purpose, and exemplified by the following methods (a) to (f):

(a) a method in which a monomer mixture is allowed to undergo polymerization reaction with a suspension polymerization method, an emulsification polymerization method, a seed polymerization method or a dispersion polymerization method, to thereby produce a dispersion liquid of vinyl fine resin particles;

(b) a method in which a monomer mixture is allowed to undergo polymerization, and the obtained resin is then pulverized using a fine pulverizer of, for example, mechanically rotating type or jetting type, followed by classifying, to thereby produce fine resin particles;

(c) a method in which a monomer mixture is allowed to undergo polymerization, and the obtained resin is then dissolved in a solvent, followed by spraying of the resultant resin solution, to thereby produce fine resin particles;

(d) a method in which a monomer mixture is allowed to undergo polymerization, the obtained resin is dissolved in a solvent, another solvent is added to the resultant resin solution to precipitate fine resin particles, and then the solvent is removed to obtain fine resin particles; or a method in which a monomer mixture is allowed to undergo polymerization, the obtained resin is dissolved in a solvent with heating, the resultant resin solution is cooled to precipitate fine resin particles, and then the solvent is removed to obtain fine resin particles;

(e) a method in which a monomer mixture is allowed to undergo polymerization, the obtained resin is dissolved in a solvent, the resultant resin solution is dispersed in an aqueous medium in the presence of an appropriate dispersing agent, and then the dispersion liquid is, for example, heated or left under reduced pressure; and (f) a method in which a monomer mixture is allowed to undergo polymerization, the obtained resin is dissolved in a solvent, an appropriate emulsifying agent is dissolved in the resultant resin solution, followed by phase-transfer emulsification with the addition of water.

Of these, method (a) is preferably employed, since vinyl fine resin particles can be easily produced as a dispersion liquid, which is easy to use for the next step.

In the polymerization reaction of method (a), preferably, (i) a dispersion stabilizer is added to the aqueous medium, (ii) the monomer mixture to be allowed to undergo polymerization reaction is made to contain a monomer capable of imparting dispersion stability to the fine resin particles obtained through polymerization (i.e., a reactive emulsifier) or the above (i) and (ii) are performed in combination, to thereby impart dispersion stability to the obtained vinyl fine resin particles. When neither the dispersion stabilizer nor the reactive emulsifier is used, the particles cannot be maintained in a dispersion state whereby the vinyl resin cannot be obtained as fine particles, the obtained fine resin particles are poor in dispersion stability whereby they are poor in storage stability resulting in aggregation during storage, or the particles are degraded in dispersion stability at the below-described fine resin particle attachment step whereby the toner core particles easily aggregate or combined together resulting in that the finally obtained toner base particles may be degraded in evenness of diameter of the toner base particles and size of protrusions, which is not preferred.

The dispersion stabilizer is not particularly limited and may be appropriately selected depending on the intended purpose. Examples thereof include a surfactant and an inorganic dispersing agent.

The surfactant includes anionic surfactants such as alkylbenzenesulfonic acid salts, α-olefin sulfonic acid salts and phosphoric acid esters; cationic surfactants such as amine salts (e.g., alkyl amine salts, aminoalcohol fatty acid derivatives, polyamine fatty acid derivatives and imidazoline), and quaternary ammonium salts (e.g., alkyltrimethylammonium salts, dialkyl dimethylammonium salts, alkyl dimethyl benzyl ammonium salts, pyridinium salts, alkyl isoquinolinium salts and benzethonium chloride); nonionic surfactants such as fatty acid amide derivatives and polyhydric alcohol derivatives; and amphoteric surfactants such as alanine, dodecyldi (aminoethyl)glycine, di(octylaminoethyl)glycine and N-alkyl-N,N-dimethylammonium betaine.

The inorganic dispersing agent includes tricalcium phosphate, calcium carbonate, titanium oxide, colloidal silica and hydroxyapatite.

The weight average molecular weight of the vinyl resin is not particularly limited and may be appropriately selected depending on the intended purpose, but is preferably 3,000 to 300,000, more preferably 4,000 to 100,000, further preferably 5,000 to 50,000. When the weight average molecular weight is less than 3,000, the vinyl resin is brittle and has low mechanical strength. Thus, the surface of the toner base particles may easily change depending on the applications or usages of the finally obtained toner base particles, which may cause various problems such as a significant change of chargeability, contaminations of surrounding members occurred by attaching the toner base particles thereto, and problems in quality accompanied therewith. When the weight average molecular weight is more than 300,000, the number of molecular ends decreases and thus the toner core particles is difficult to be entangled with molecular chains, which may prevent the vinyl resin from attaching to the toner core particles. Needless to say, both cases are not preferred.

The glass transition temperature (Tg) of the vinyl resin is not particularly limited and may be appropriately selected depending on the intended purpose, but is preferably 45° C. to 100° C., more preferably 55° C. to 90° C., further preferably 65° C. to 80° C. When stored under high-temperature and high-humidity environment, atmospheric moisture may plasticize the resin in the protrusions to thereby decrease the glass transition temperature. Thus, when the glass transition temperature is lower than 45° C., the obtained toner base particles are deformed under application of a certain pressure or stick to each other. As a result, there is a possibility that the toner base particles cannot behave as particles. In addition, when used for a one-component developer, the toner becomes poor in durability against friction. Whereas when the Tg exceeds 100° C., the low-temperature fixing property may be degraded. Needless to say, both cases are not preferred.

The latent electrostatic image developing toner is suitably produced according to the following method.

<Preparation Step of Oil Phase>

The oil phase, which contains an organic solvent, and materials such as a resin and a colorant dissolved or dispersed in the organic solvent, may be prepared in the following manner. Specifically, the materials such as the resin and the colorant are gradually added to the organic solvent under stirring so that these materials are dissolved or dispersed therein. Notably, when a pigment is used as the colorant and/or when materials such as the releasing agent and the charge controlling agent used are poorly dissolvable to the organic solvent, the particles of these materials are preferably micronized before the addition to the organic solvent.

As described above, the colorant may be formed into a masterbatch. Similarly, the materials such as the releasing agent and the charge controlling agent may be formed into a masterbatch.

In another method, the colorant, the releasing agent and the charge controlling agent may be dispersed through a wet process in the organic solvent, if necessary in the presence of a dispersion aid, to thereby obtain a wet master.

In still another method, when dispersing the materials melted at a temperature lower than the boiling point of the organic solvent, they are heated under stirring in the organic solvent, if necessary in the presence of a dispersion aid to be stirred together with the dispersoids; and the resultant solution is cooled with stirring or shearing so that the dissolved materials are crystallized, to thereby produce microcrystals of the dispersoids.

After the colorant, releasing agent and charge controlling agent, dispersed with any of the above means, have been dissolved or dispersed in the organic solvent together with a resin, the resultant mixture may be further dispersed. The dispersion may be performed using a known disperser such as a bead mill or a disc mill.

<Preparation Step of Toner Core Particles>

No particular limitation is imposed on the method for preparing a dispersion liquid containing toner core particles formed of the oil phase by dispersing the oil phase obtained at the above-described step in the aqueous medium containing at least the surfactant. This method may use a known disperser such as a low-speed shearing disperser, a high-speed shearing disperser, a friction disperser, a high-pressure jet disperser or an ultrasonic disperser. Among them, a high-speed shearing disperser is preferably used to form dispersoids having a particle diameter of 2 μm to 20 μm.

The rotation speed of the high-speed shearing disperser is not particularly limited and may be appropriately selected depending on the intended purpose, but is generally 1,000 rpm to 30,000 rpm, preferably 5,000 rpm to 20,000 rpm. The dispersion time is not particularly limited and may be appropriately selected depending on the intended purpose, but is generally 0.1 min to 5 min in a batch method. When the dispersion time exceeds 5 min, unfavorable small particles remain and excessive dispersion is performed to make the dispersion system unstable, potentially forming aggregates and coarse particles, which is not preferred. The dispersion temperature is not particularly limited and may be appropriately selected depending on the intended purpose, but is generally 0° C. to 40° C., preferably 10° C. to 30° C. When the dispersion temperature exceeds 40° C., molecular movements are excited to degrade dispersion stability, easily forming aggregates and coarse particles, which is not preferred. Whereas when the dispersion temperature is lower than 0° C., the dispersion liquid is increased in viscosity to require elevated energy for dispersion, leading to a drop in production efficiency.

The surfactant usable is not particularly limited, and may be the same as those mentioned in the above-described production method of the fine resin particles. In order to efficiently disperse the oil droplets containing the solvent, the surfactant used is preferably a disulfonic acid salt having a relatively high HLB.

The concentration of the surfactant in the aqueous medium is not particularly limited and may be appropriately selected depending on the intended purpose, but is 1% by mass to 10% by mass, more preferably 2% by mass to 8% by mass, more preferably 3% by mass to 7% by mass. When the concentration thereof exceeds 10% by mass, each oil droplet becomes too small and also has a reverse micellar structure. Thus, the dispersion stability is degraded due to the surfactant added in such an amount, to thereby easily form coarse oil droplets. Whereas when the concentration thereof is lower than 1% by mass, the oil droplets cannot be stably dispersed to form coarse oil droplets. Needless to say, both cases are not preferred.

Also, the concentration of a surfactant is preferably lower in order to form desired protrusions in the below-described protrusion formation step (hereinafter may be referred to as "fine resin particle attachment step"). Specifically, the concentration of a surfactant in the aqueous medium is preferably 3% by mass to 7% by mass. The reason for this is thought to lie in the following. That is, presumably, the fine resin particles are incorporated into each toner core particle where they are swelled, and the fine resin particles are localized on the surfaces of the toner core particles upon removal of the organic solvent in the below-described desolvation step. When the concentration of the surfactant is too high, the wettability of the surfaces of the toner core particles becomes too high. As a result, the fine resin particles are not incorporated and remain on the surfaces of the toner core particles or the dispersion solvent. Or, even when incorporated into the toner core particles, they are released from the toner core particles upon localization on the surface.

<Protrusion Formation Step (Fine Resin Particle Attachment Step)>

The dissolution suspension method may be performed as described above. However, the following method is preferably employed since the fine resin particles are attached onto or fused with the toner core particles more firmly. Specifically, the method includes dissolving or dispersing materials of the toner core particles in an organic solvent to prepare an oil phase, dispersing the oil phase in an aqueous medium, and adding fine resin particles so as to be attached onto and fused with the surfaces of the toner core particles to obtain a toner base particle dispersion liquid. Addition of the fine resin particles at the production step of toner core particles forms large, ununiform protrusions, which cannot be preferred in some cases.

The obtained toner core particle dispersion liquid contains stable liquid droplets of the toner core particles, so long as the dispersion liquid is being stirred. For attaching the fine resin particles onto the toner core particles, the fine resin particle dispersion liquid is added to this core particle slurry. The period for which the vinyl fine resin particle dispersion liquid is added is not particularly limited, but is preferably 30 sec or longer. When it is added for 30 sec or shorter, the dispersion system drastically changes to form aggregated particles. In addition, the vinyl fine resin particles are ununiformly attached onto the core particles, which is not preferred. Meanwhile, adding the vinyl fine resin particle dispersion liquid over an unnecessarily long period of time (e.g., 60 min or longer) cannot be preferred in some cases from the viewpoint of lowering production efficiency.

Before added to the core particle dispersion liquid, the vinyl fine resin particle dispersion liquid may be appropriately diluted or concentrated so as to have a desired concentration. The concentration of the vinyl fine resin particle dispersion liquid is not particularly limited and may be appropriately selected depending on the intended purpose, but is preferably 5% by mass to 30% by mass, more preferably 8% by mass to 20% by mass. When the concentration is less than 5% by mass, the concentration of the organic solvent greatly changes upon addition of the dispersion liquid to lead to insufficient attachment of the fine resin particles, which cannot be preferred in some cases. Also, when the concentration exceeds 30% by mass, the fine resin particles tend to be localized in the toner core particle dispersion liquid, resulting in that the fine resin particles are ununiformly attached onto the toner core particles, which cannot be preferred in some cases.

Also, for the production of liquid droplets of the oil phase, the amount of the surfactant contained in the aqueous phase is not particularly limited and may be appropriately selected depending on the intended purpose, but is preferably 7% by mass or less, more preferably 6% by mass or less, further preferably 5% by mass or less. When the amount of the surfactant exceeds 7% by mass, the length of the long sides of the protrusions becomes considerably ununiform or the fine resin particles cannot attach to the toner core particles in some cases, which cannot be preferred in some cases.

The following may explain the reason why the vinyl fine resin particles are sufficiently firmly attached onto the toner core particles by the method of the present invention. Specifically, when the vinyl fine resin particles are attached onto the liquid droplets of the toner core particles, the toner core particles can freely deform to sufficiently form contact surfaces with the vinyl fine resin particles and the vinyl fine resin particles are swelled with or dissolved in the organic solvent to make it easier for the vinyl fine resin particles to adhere to the resin in the toner core particles. Therefore, in the form of toner core particle dispersion liquid, the organic solvent must exist in the system in a sufficiently large amount. The amount of the organic solvent is preferably 50% by mass to 150% by mass, more preferably 70% by mass to 125% by mass, relative to the amount of the solid matter (e.g., resin, colorant, if necessary, releasing agent and charge controlling agent). When the amount of the organic solvent exceeds 150% by mass, the amount of the colored resin particles obtained through one production process is reduced, resulting in low production efficiency. Also, a large amount of the organic solvent impairs dispersion stability, making it difficult to attain stable production, which cannot be preferred in some cases.

The temperature at which the vinyl fine resin particles are made to attach onto the core particles is not particularly limited and may be appropriately selected depending on the intended purpose, but is preferably 10° C. to 60° C., more preferably 20° C. to 45° C. When it exceeds 60° C., required energy for production is elevated to increase environmental loading, and the presence of vinyl fine resin particles having a low acid value on the surfaces of liquid droplets makes the dispersion system to be unstable to thereby potentially form coarse particles. Meanwhile, when the temperature is less than 10° C., the dispersion liquid is increased in viscosity, leading to an insufficiently attachment of the fine resin particles. Needless to say, both cases are not preferred.

The rate of a mass of the resin of which the protrusions are made to a total mass of the toner is not particularly limited and may be appropriately selected depending on the intended purpose, but is preferably 1% to 20%, more preferably 3% to 15%, further preferably 5% to 10%. When the rate thereof is less than 1%, the coverage rate of the toner core particles becomes low, and thus the protrusions cannot exert satisfactory effects in some cases. Whereas when the rate thereof is more than 20%, excessive resin is exfoliated from the toner core particles, causing, for example, contamination of members. Needless to say, both cases are not preferred. When the rate thereof is 5% to 10%, it is advantageous in that the protrusions are in proper quantities and uniformity can be kept high.

<Desolvation Step>

In one employable means for removing the organic solvent from the obtained toner base particle dispersion liquid, the entire system is gradually increased in temperature with stirring, to thereby completely evaporate off the organic solvent contained in the liquid droplets.

In another employable means, the obtained toner base particle dispersion liquid with stirring is sprayed toward a dry atmosphere, to thereby completely evaporate off the organic solvent contained in the liquid droplets. In still another employable means, the toner base particle dispersion liquid is reduced in pressure with stirring to evaporate off the organic solvent. The latter two means may be used in combination with the first means.

The dry atmosphere toward which the emulsified dispersion liquid is sprayed is not particularly limited and may be appropriately selected depending on the intended purpose, but generally uses heated gas (e.g., air, nitrogen, carbon dioxide and combustion gas), especially, gas flow heated to a temperature equal to or higher than the highest boiling point of the solvents used. By removing the organic solvent even in a short time using, for example, a spray dryer, a belt dryer or a rotary kiln, the resultant product has satisfactory quality.

<Aging Step>

When a modified resin having an end isocyanate group is added, an aging step may be performed to allow elongation or crosslinking reaction of the isocyanate to proceed. The aging time is generally 10 min to 40 hours, preferably 2 hours to 24 hours. The aging temperature is generally 0° C. to 65° C., preferably 35° C. to 50° C.

<Washing Step>

The dispersion liquid of the toner base particles obtained in the above-described manner contains not only the toner base particles but also subsidiary materials such as a dispersing agent (e.g., a surfactant). Thus, the dispersion liquid is washed to separate the toner base particles from the subsidiary materials. Examples of the washing method for separating the toner base particles include a centrifugation method, a reduced-pressure filtration method and a filter press method, but employable washing methods in the present invention are not limited thereto. Any of the above methods forms a cake of the toner base particles. If the toner base particles are not sufficiently washed through only one washing process, the formed cake may be dispersed again in an aqueous solvent to form a slurry, which is repeatedly treated with any of the above methods to taken out the toner base particles. When a reduced-pressure filtration method or a filter press method is employed for washing, an aqueous solvent may be made to penetrate the cake to wash out the subsidiary materials contained in the toner base particles. The aqueous solvent used for washing is water or a solvent mixture of water and an alcohol such as methanol or ethanol. Use of only water is preferred from the viewpoint of reducing cost and environmental load caused by, for example, drainage treatment.

<Drying Step>

The washed toner base particles containing the aqueous medium in a large amount are dried to remove the aqueous medium, whereby only toner base particles can be obtained. The drying method is not particularly limited and uses, for example, a spray dryer, a vacuum freezing dryer, a reduced-pressure dryer, a ventilation shelf dryer, a movable shelf dryer, a fluidized-bed-type dryer, a rotary dryer or a stirring-type dryer. The toner base particles are preferably dried until the water content is finally decreased less than 1% by mass. Also, when the dry toner base particles flocculate to cause inconvenience in use, the flocculated particles may be separated from each other through beating using, for example, a jet mill, HENSCHEL MIXER, a super mixer, a coffee mill, an oster blender or a food processor.

<Particle Diameter of Toner>

The latent electrostatic image developing toner of the present invention preferably have a volume average particle diameter of preferably 3 μm to 9 μm, more preferably 4 μm to 8 μm, further preferably 4 μm to 7 μm, in order for the toner particles to be charged uniformly and sufficiently. The toner particles having a volume average particle diameter less than 3 μm are relatively increased in toner adhesion force, which cannot be preferred in some cases since the operability of the toner particles is reduced under an electrical field. The toner particles having a volume average particle diameter exceeding 9 μm form an image whose image qualities (e.g., reproducibility of thin lines) may be degraded.

Also, in the toner particles, the ratio of the volume average particle diameter to the number average particle diameter (volume average particle diameter/number average particle diameter) is preferably 1.25 or less, more preferably 1.20 or less, still more preferably 1.17 or less. When the ratio therebetween exceeds 1.25; i.e., the toner particles have low uniformity in particle diameter, the size or height of the protrusions tends to be varied. In addition, during repetitive use, toner particles having a large particle diameter or, in some cases, toner particles having small particle diameter are preferentially consumed, so that the average particle diameter of the toner particles remaining in the developing device is changed from that of the toner particles at an initial state. Thus, the developing conditions initially set are not optimal for development of the remaining toner particles. As a result, various unfavorable phenomena tend to occur including charging failure, considerable increase or decrease of the amount of toner particles conveyed, toner clogging and toner leakage.

Examples of employable apparatus for measuring the volume average particle diameter, the number average particle diameter, and the particle size distribution of the toner particles include a COULTER COUNTER TA-II and COULTER MULTISIZER II (these products are of Coulter, Inc.). The measurement method will next be described.

First, a surfactant (0.1 mL to 5 mL), preferably an alkylbenzene sulfonic acid salt, is added as a dispersing agent to an electrolyte solution (100 mL to 150 mL). Here, the electrolyte solution is an about 1% by mass aqueous NaCl solution prepared using the 1st grade sodium chloride, and examples of commercially available products thereof include ISOTON-II (product of Coulter, Inc.). Subsequently, a measurement sample (2 mg to 20 mg) is suspended in the above-obtained electrolyte solution. The resultant electrolyte solution is dispersed with an ultrasonic wave disperser for about 1 min to about 3 min. The thus-obtained dispersion liquid is analyzed with the above-described apparatus using an aperture of 100 μm to measure the number or volume of the toner particles. Then, the volume particle size distribution and number particle size distribution are calculated from the obtained values. From these distributions, the volume average particle diameter (D4) and the number average particle diameter (D1) of the toner can be obtained.

Notably, in this measurement, 13 channels are used: 2.00 μm (inclusive) to 2.52 μm (exclusive); 2.52 μm (inclusive) to 3.17 μm (exclusive); 3.17 μm (inclusive) to 4.00 μm (exclusive); 4.00 μm (inclusive) to 5.04 μm (exclusive); 5.04 μm (inclusive) to 6.35 μm (exclusive); 6.35 μm (inclusive) to 8.00 μm (exclusive); 8.00 μm (inclusive) to 10.08 μm (exclusive); 10.08 μm (inclusive) to 12.70 μm (exclusive); 12.70 μm (inclusive) to 16.00 μm (exclusive); 16.00 μm (inclusive) to 20.20 μm (exclusive); 20.20 μm (inclusive) to 25.40 μm (exclusive); 25.40 μm (inclusive) to 32.00 μm (exclusive); and 32.00 μm (inclusive) to 40.30 μm (exclusive); i.e., particles having a particle diameter of 2.00 μm (inclusive) to 40.30 μm (exclusive) are subjected to the measurement.

<Average Sphericity of Toner Particle>

The average sphericity of the toner particles is not particularly limited and may be appropriately selected depending on the intended purpose, but preferably 0.930 or more, more preferably 0.950 or more, further preferably 0.970 or more. When the average sphericity is less than 0.930, the external additives are accumulated in concave portions to prevent the silicone oil from sufficiently being supplied. Also, the toner having an average sphericity less than 0.930 is poor in flowability to easily cause failures upon development as well as to be degraded in transfer efficiency. Needless to say, both cases are not preferred.

The average sphericity of the toner particles can be measured using a flow-type particle image analyzer FPIA-2000. Specifically, 0.1 mL to 0.5 mL of a surfactant (preferably an alkylbenzene sulfonic acid salt) is added as a dispersing agent into 100 mL to 150 mL of water in a container, from which solid impurities have previously been removed. Then, about 0.1 g to about 0.5 g of a measurement sample is added to the container, followed by dispersing. The resultant suspension is subjected to dispersing treatment by an ultrasonic disperser for about 1 min to about 3 min, and the concentration of the dispersion liquid is adjusted such that the number of particles of the sample is 3,000 per microliter to 10,000 per microliter. In this state, the shape and distribution of the toner are measured using the above analyzer.

In the case of the toner produced by the wet granulation method, ionic toner materials are localized in the vicinity of the surface of the toner. As a result, the surface layer of the toner is relatively low in resistance to improve the toner in charging speed and charge rising property. However, such toner has poor charge retentability; in other words, it is easy for the charge amount of the toner to rapidly decrease. The method for improving this problem is, for example, a method in which a surface modifier is allowed to be supported on the surface of the toner.

<Measurement of Average Particle Diameter of Resin Particles>

The average particle diameter of the fine resin particles was measured using UPA-150EX (product of NIKKISO CO., LTD.).

The average particle diameter of the fine resin particles is not particularly limited and may be appropriately selected depending on the intended purpose, but is preferably 50 nm to 200 nm, more preferably 80 nm to 160 nm, further preferably 100 nm to 140 nm. When the particle diameter is smaller than 50 nm, it is difficult to form sufficiently large protrusions on the toner surface. When the particle diameter exceeds 200 nm, the formed protrusions become ununiform, which cannot be preferred in some cases. Also, in the fine resin particles, the ratio of the volume average particle diameter to the number average particle diameter (volume average particle diameter/number average particle diameter) is preferably 1.25 or less, more preferably 1.20 or less, still more preferably 1.17 or less. When the particle diameter of the fine resin particles exceeds 1.25; i.e., the fine resin particles are poor in uniformity of particle diameter, the size of the formed protrusions tends to be varied.

<Measurement of Molecular Weight (GPC)>

The molecular weight of the resin was measured through GPC (gel permeation chromatography) under the following conditions.

Apparatus: GPC-150C (product of Waters Co.)
Column: KF801 to 807 (product of Shodex Co.)
Temperature: 40° C.
Solvent: THF (tetrahydrofuran)
Flow rate: 1.0 mL/min
Sample injected: 0.1 mL of a sample having a concentration of 0.05% to 0.6%

From the molecular weight distribution of the resin measured under the above conditions, the number average molecular weight and the weight average molecular weight of the resin were calculated using a molecular weight calibration curve obtained from monodispersed polystyrene standard samples. The standard polystyrene samples used for obtaining the calibration curve were toluene and Std. Nos. S-7300, S-210, S-390, S-875, S-1980, S-10.9, S-629, S-3.0 and S-0.580 of Showdex STANDARD (product of SHOWA DENKO K.K.). The detector used was a RI (refractive index) detector.

<Measurement of Glass Transition Temperature (Tg) (DSC)>

The Tg was measured using TG-DSC system TAS-100 (product of Rigaku Denki Co., Ltd.).

A sample (about 10 mg) is placed in an aluminum container, which is placed on a holder unit. The holder unit is then set in an electric oven. The sample is heated from room temperature to 150° C. at a temperature increasing rate of 10° C./min, left to stand at 150° C. for 10 min, cooled to room temperature, and left to stand for 10 min. In a nitrogen atmosphere, the sample is heated again to 150° C. at a temperature increasing rate of 10° C./min for DSC analysis. Using the analysis system of TAS-100 system, the Tg is calculated from the tangent point between the base line and the tangential line of the endothermic curve near the Tg.

<Measurement of Concentration of Solid Matter>

The concentration of solid matter contained in the oil phase was measured as follows.

An aluminum plate (about 1 g to about 3 g) is accurately weighed in advance. About 2 g of the oil phase is placed on the aluminum plate within 30 sec, and then the oil phase placed thereon is accurately weighed. The aluminum plate is placed for 1 hour in an oven set to 150° C. to evaporate the solvent. Thereafter, the aluminum plate is taken out from the oven and left to cool. Subsequently, the total mass of the aluminum plate and solid matter of the oil phase is measured with an electronic balance. The mass of the aluminum plate is subtracted from the total mass of the aluminum plate and the solid matter contained in the oil phase to obtain the mass of the solid matter contained in the oil phase, which is divided by the mass of the oil phase placed on the aluminum plate to obtain the concentration of the solid matter contained in the oil phase. Also, the ratio of the solvent to the solid matter contained in the oil phase is a value obtained from the following: (the mass of the oil phase—the mass of the solid matter contained in the oil phase); i.e., the mass of the solvent/the mass of the solid matter contained in the oil phase.

<Measurement of Acid Value of Resin>

The acid value of the resin is measured according to JIS K1557-1970, which will be specifically described below.

About 2 g of a pulverized sample is accurately weighed (W (O). The sample is added to a 200 mL conical flask. Then, 100 mL of a solvent mixture of toluene/ethanol (2:1 by mass) is added to the flask. The resultant mixture is left to stand for 5 hours for dissolution. A phenolphthalein solution serving as an indicator is added to the solution.

The resultant solution is titrated with 0.1N alcohol solution of potassium hydroxide. The amount of the KOH solution is defined as S (mL).

A blank test is performed, and the amount of the KOH solution is defined as B (mL).

The acid value is calculated using the following equation:

$$\text{Acid value}=[(S-B)\times f\times 5.61]/W$$

where f denotes a factor of the KOH solution.

The electrostatic image developing toner of the present invention may be used as a one-component developer or a two-component developer composed of an electrostatic image developing toner and an electrostatic image developing carrier. The developer of the present invention can provide excellent durability, keep chargeability over a long time, and stably form high-quality images.

Notably, the electrostatic image developing carrier (carrier) used for the electrophotographic developer of the present invention is not particularly limited, but includes a carrier core material coated with a coating layer containing a binder resin and electric conductive fine particles.

The carrier core material is not particularly limited, and known electrophotographic two-component carriers may be appropriately selected and used depending on the application and intended purpose such as ferrite, Cu—Zn ferrite, Mn ferrite, Mn—Mg ferrite, Mn—Mg—Sr ferrite, magnetite, iron, and nickel.

Also, the electrostatic image developing toner of the present invention may be charged into a container before use. The toner container containing the toner becomes stable to, for example, changes in environment, allowing simple and easy handling. This usage form also leads to prevention of contamination of the apparatus.

(Image Forming Apparatus and Image Forming Method)

An image forming apparatus of the present invention includes at least a latent image bearing member which bears a latent image thereon, a charging unit configured to uniformly charge the surface of the latent image bearing member, an exposing unit configured to expose the charged surface of the latent image bearing member to light based on the image data to form a latent electrostatic image, a developing unit configured to develop, with a toner, the latent electrostatic image formed on the surface of the latent image bearing member to form a visible image, a transfer unit configured to transfer the visible image from the latent image bearing member surface onto an image-receiving medium and a fixing unit configured to fix the visible image on the image-receiving medium; and, if necessary, further includes appropriately selected other units such as a charge-eliminating unit, a cleaning unit, and a recycling unit.

An image forming method of the present invention includes a charging step which is a step of uniformly charging a surface of a latent image bearing member; an exposing step which is a step of exposing the charged surface of the latent image bearing member to light based on image data to form a latent electrostatic image; a developing step which is a step of developing, with a toner, the latent electrostatic image formed on the surface of the latent image bearing member to form a visible image on the surface of the latent image bearing member; a transfer step which is a step of transferring, onto an image-receiving medium, the visible image on the surface of the latent image bearing member; and a fixing step which is a step of fixing the visible image on the image-receiving medium. The image forming method of the present invention includes at least a latent electrostatic image-forming step, the developing step, the transfer step, and the fixing step; and, if necessary, further includes appropriately selected other steps such as a charge-eliminating step, a cleaning step, and a recycling step.

The formation of the latent electrostatic image can be performed in the following manner, for example. Specifically, the surface of the latent image bearing member is uniformly charged by the charging unit and then exposed to light by the exposing unit.

The formation of the visible image through development is performed in the following manner. Specifically, a toner layer is formed on a developing roller serving as a developer bearing member. Then, the toner layer on the developing roller is conveyed so as to come into contact with a photoconductor drum serving as a latent image bearing member to develop a latent electrostatic image on the photoconductor drum.

The toner is stirred with a stirring unit and mechanically supplied to a developer supplying member.

The toner is supplied from the developer supplying member and deposited on the developer bearing member. Then, the toner is made to pass through a developer layer regulating member provided so as to be in contact with the surface of the developer bearing member, so that the toner is formed into a uniform thin layer and also charged.

The charged toner is attached with the developing unit onto the latent electrostatic image formed on the latent electrostatic image bearing member in a developing region, so that the latent electrostatic image is developed to be a toner image.

The transfer of the visible image can be performed with the transfer unit by, for example, charging the latent image bearing member (photoconductor) with a transfer charging device which is one of the transfer unit.

The fixing of the transferred visible images can be performed by, for example, fixing the visible image transferred onto the recording media with a fixing unit. The fixing of the visible images of colors may be performed every time when each toner is transferred onto the recording media or at one time after the visible images of colors have been mutually superposed.

The fixing unit is not particularly limited and may be appropriately selected depending on the intended purpose. The fixing unit is preferably a known heat-press unit.

Examples of the heat-press unit include a combination of a heating roller and a pressing roller and a combination of a heating roller, a pressing roller and an endless belt.

Notably, the heating temperature of the heat-press unit is preferably 80° C. to 200° C.

Next, a basic configuration of the image forming apparatus (printer) according to an embodiment of the present invention will be further explained with reference to the following figures.

<Image Forming Apparatus>

Figure 3:
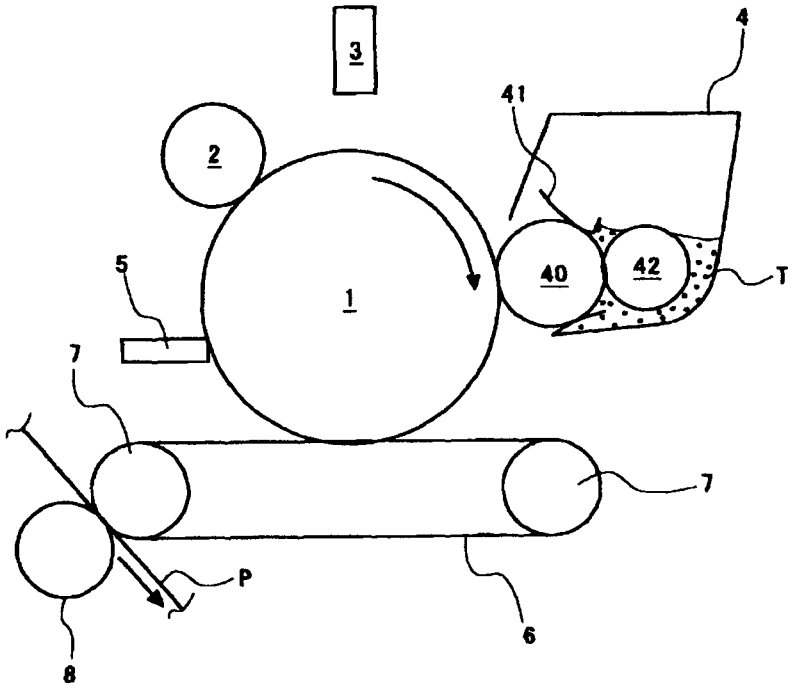
FIG. 3 is a cross-sectional schematic view of one exemplary image forming apparatus according to an embodiment of the present invention.

FIG. 3 illustrates one exemplary image forming apparatus of the present invention. This image forming apparatus contains, in an unillustrated main body casing, a latent image bearing member (1) rotated clockwise in FIG. 3 which is provided therearound with a charging unit (2), an exposing unit (3), a developing unit (4) having the electrostatic image developing toner (T) of the present invention, a cleaning unit (5), an intermediate transfer medium (6), a supporting roller (7), a transfer roller (8), an unillustrated charge-eliminating unit, and other members.

This image forming apparatus has an unillustrated paper-feeding cassette containing a plurality of recording paper sheets (P), which are recording media. The recording paper sheets (P) in the paper-feeding cassette are fed one by one with an unillustrated paper-feeding roller to between the intermediate transfer medium (6) and the transfer roller (8) serving as a transfer unit. Before fed to therebetween, the recording paper sheet is retained with a pair of registration rollers so that it can be fed at a desired timing.

In this image forming apparatus, while being rotated clockwise in FIG. 3, the latent image bearing member (1) is uniformly charged with the charging unit (2). Then, the latent image bearing member (1) is irradiated with laser beams modulated by image date from the exposing unit (3), to thereby form a latent electrostatic image. The latent electrostatic image formed on the latent image bearing member (1) is developed with the toner using the developing unit (4). Next, the toner image formed with the developing unit (4) is transferred from the latent image bearing member (1) to the intermediate transfer medium (6) through application of transfer bias. Separately, the recording paper sheet (P) is fed to between the intermediate transfer medium (6) and the transfer roller (8), whereby the toner image is transferred onto the recording paper sheet (P). Moreover, the recording paper sheet (P) with the toner image is conveyed to an unillustrated fixing unit.

The fixing unit has a fixing roller and a press roller, wherein the fixing roller is heated to a predetermined temperature and the press roller is pressed against the fixing roller at a predetermined pressure. The fixing unit heats and presses the recording paper sheet conveyed from the transfer roller (8), to thereby fix the toner image on the recording paper sheet, which is then discharged to an unillustrated discharge tray.

In the image forming apparatus after the above-described recording process, the latent image bearing member (1), from which the toner image has been transferred by the transfer roller (8) onto the recording paper sheet, is further rotated to reach the cleaning part (5), where the toner remaining on the surface of the latent image bearing member (1) is scraped off. Then, the latent image bearing member (1) is charge-eliminated with an unillustrated charge-eliminating unit. The image forming apparatus uniformly charges, with the charging unit (2), the latent image bearing member (1) which has been charge-eliminated by the charge-eliminating device, and performs the next image formation in the same manner as described above.

Next will be described in detail the members suitably used in the image forming apparatus of the present invention.

The material, shape, structure and size of the latent image bearing member (1) are not particularly limited and may be appropriately selected from those know in the art. The latent image bearing member is suitably in the form of a drum or belt, and is, for example, an inorganic photoconductor made of, for example, amorphous silicon or selenium and an organic photoconductor made of, for example, polysilane or phthalopolymethine. Of these, an amorphous silicon photoconductor or an organic photoconductor is preferred since it has a long service life.

The latent electrostatic image can be formed on the latent image bearing member (1) with a latent electrostatic image-forming unit by, for example, imagewise exposing the charged surface of the latent image bearing member (1). The latent electrostatic image-forming unit contains at least the charging unit (2) which charges the surface of the latent image bearing member (1) and the exposing unit (3) which imagewise exposes the surface of the latent image bearing member (1).

The charging step can be performed by, for example, applying a voltage to the surface of the latent image bearing member (1) using the charging unit (2).

The charging unit (2) is not particularly limited and may be appropriately selected depending on the intended purpose. Examples thereof include contact-type chargers known per se having, for example, a conductive or semiconductive roller, a brush, a film and a rubber blade; and non-contact-type chargers utilizing colona discharge such as corotron and scorotron.

The charging unit (2) may be a charging roller as well as a magnetic brush or a fur brush. The shape thereof may be suitably selected according to the specification or configuration of an electrophotographic apparatus. When a magnetic brush is used as the charging unit, the magnetic brush is composed of a charging member of various ferrite particles such as Zn—Cu ferrite, a non-magnetic conductive sleeve to support the ferrite particles, and a magnetic roller included in the non-magnetic conductive sleeve. Also, the fur brush is, for example, a fur treated to be conductive with, for example, carbon, copper sulfide, a metal or a metal oxide, and the fur is coiled or mounted to a metal or a metal core which is treated to be conductive, thereby obtaining the charging unit.

The charging unit (2) is not limited to the aforementioned contact-type chargers. However, the contact-type chargers are preferably used from the viewpoint of reducing the amount of ozone generated from the charger in the image forming apparatus.

The exposing can be performed by, for example, imagewise exposing the photoconductor surface with the exposing unit (3). The exposing unit (3) is not particularly limited and may be appropriately selected depending on the intended purpose, so long as it attains desired imagewise exposure to the surface of the latent image bearing member (1) charged with the charging unit (2). Examples thereof include various exposing devices such as a copy optical exposing device, a rod lens array exposing device, a laser optical exposing device and a liquid crystal shutter exposing device.

The developing can be performed by, for example, developing the latent electrostatic image with the toner of the present invention using the developing unit (4). The developing unit (4) is not particularly limited, so long as it attains development using the toner of the present invention, and may be appropriately selected from known developing units. Preferred examples of the developing units include those having a developing unit which has the toner of the present invention therein and which can apply the toner to the latent electrostatic image in a contact or non-contact manner.

The developing unit (4) preferably has a developing roller (40) and a thin layer-forming member (41). Here, the developing roller (40) has a toner on the circumferential surface thereof and supplies the toner to the latent electrostatic image formed on the latent image bearing member (1) while being rotated together with the latent image bearing member (1) the developing roller (40) is in contact with. The thin layer-forming member (41) comes into contact with the circumferential surface of the developing roller (40) to form a thin layer of the toner on the developing roller (40).

The developing roller (40) used is preferably a metal roller or elastic roller. The metal roller is not particularly limited and may be appropriately selected depending on the intended purpose. Examples thereof include an aluminum roller. By treating the metal roller through blast treatment, the developing roller (40) having a desired surface friction coefficient can be formed relatively easily. Specifically, an aluminum roller can be treated through glass bead blasting to roughen the roller surface. The thus-obtained developing roller can attach an appropriate amount of toner thereonto.

The elastic roller used is a roller coated with an elastic rubber layer. The roller is further provided thereon with a surface coat layer made of a material that is easily chargeable at the opposite polarity to that of the toner. The hardness of the elastic rubber layer is set to be equal to or lower than 60° according to JIS-A, in order to prevent the toner from being degraded due to pressure concentration at a contact region between the elastic rubber layer and the thin layer-forming member (41). The surface roughness (Ra) of the elastic rubber layer is set to be 0.3 μm to 2.0 μm so as to retain, on its surface, the toner in a necessary amount. Also, since the developing roller (40) receives a developing bias for forming an electrical field between the developing roller (40) and the latent image bearing member (1), the resistance of the elastic rubber layer is set to be $10^3\Omega$ to $10^{10}\Omega$. The developing roller (40) is rotated counterclockwise to convey the toner retained thereon to positions where the developing roller (40) faces the thin layer forming member (41) and the latent image bearing member (1).

The thin layer-forming member (41) is provided upstream of the contact region between the supply roller (42) and the developing roller (40) in a direction in which the developing roller (40) is rotated. The thin layer-forming member (41) is a metal plate spring of stainless steel (SUS) or phosphor bronze, and its free end is brought into contact with the surface of the developing roller (40) at a press force of 10 N/m to 40 N/m. The thin layer-forming member (41) forms the toner passing thereunder into a thin layer by the press force and frictionally charges the toner. In addition, for aiding frictional charging, the thin layer forming member (41) receives a regulation bias having a value offset in the same direction of the polarity of the toner against the developing bias.

The rubber elastic material forming the surface of the developing roller (40) is not particularly limited and may be appropriately selected depending on the intended purpose. Examples thereof include styrene-butadiene copolymer rubbers, butadiene copolymer rubbers, acrylonitrile-butadiene copolymer rubbers, acrylic rubbers, epichlorohydrin rubbers, urethane rubbers, silicone rubbers and blends of two or more of them. Of these, particularly preferred are blend rubbers of epichlorohydrin rubbers and acrylonitrile-butadiene copolymer rubbers.

The developing roller (40) is produced by, for example, coating the circumference of a conductive shaft with the rubber elastic material. The conductive shaft is made, for example, of a metal such as stainless steel (SUS).

The transfer can be performed by, for example, charging the latent image bearing member (1) with a transfer roller. The transfer roller preferably has a primary transfer unit configured to transfer the toner image onto the intermediate transfer medium (6) to form a transfer image; and a secondary transfer unit (transfer roller (8)) configured to transfer the transfer image onto a recording paper sheet (P). More preferably, in response to the case where toners of two or more colors, preferably, full color toners are used, the transfer roller has a primary transfer unit configured to transfer the toner images onto the intermediate transfer medium (6) to form a composite transfer image; and a secondary transfer unit configured to transfer the composite transfer image onto a recording paper sheet (P).

Notably, the intermediate transfer medium (6) is not particularly limited and may be appropriately selected from known transfer media. Preferred examples thereof include a transfer belt.

The transfer unit (the primary transfer unit or the secondary transfer unit) preferably has at least a transfer device which charge-separates the toner image from the latent image bearing member (1) toward the recording paper sheet (P). The number of the transfer unit may be one or more. Examples of the transfer unit include a corona transfer device using colona discharge, a transfer belt, a transfer roller, a pressure transfer roller and an adhesive transfer device.

Notably, typical examples of the recording paper sheet (P) include plain paper. The recording paper sheet, however, is not particularly limited and may be appropriately selected depending on the intended purpose, so long as it can receive an unfixed image formed after development. Further examples of the recording paper sheet employable include PET bases for use in OHP.

The fixing can be performed by, for example, fixing the toner image transferred onto the recording paper sheet (P) with a fixing unit. The fixing of the toner images of colors may be performed every time when each toner image is transferred onto the recording paper sheet (P) or at one time after the toner images of colors have been mutually superposed.

The fixing unit is not particularly limited and may be appropriately selected depending on the intended purpose. The fixing unit is preferably a known heat-press unit. Examples of the heat-press unit include a combination of a heating roller and a pressing roller and a combination of a heating roller, a pressing roller and an endless belt. Notably, the heating temperature of the heat-press unit is preferably 80° C. to 200° C.

Figure 4:
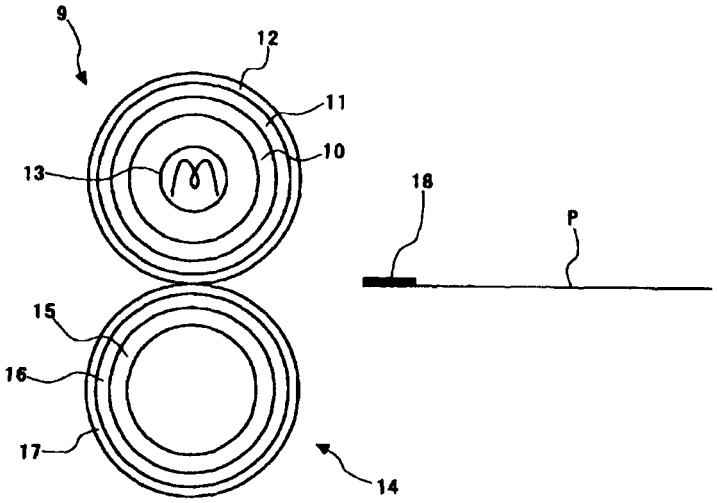
FIG. 4 is a cross-sectional schematic view of one exemplary fixing unit.

The fixing device may be a soft roller-type fixing device having fluorine-containing surface layers as illustrated in FIG. 4. This fixing unit has a heat roller (9) and a press roller (14). The heat roller (9) has an aluminum core (10), an elastic material layer (11) of silicone rubber, PFA (tetrafluoroethylene-perfluoroalkyl vinyl ether copolymer) surface layer (12) and a heater (13), where the elastic material layer (11) and the PFA surface layer (12) are provided on the aluminum core (10) and the heater (13) is provided inside the aluminum core (10). The press roller (14) has an aluminum core (15), an elastic material layer (16) of silicone rubber and a PFA surface layer (17), where the elastic material layer (16) and the PFA surface layer (17) are provided on the aluminum core (15). Notably, the recording paper sheet (P) having an unfixed image (18) is fed as illustrated.

Notably, in the present invention, a known optical fixing device may be used in addition to or instead of the fixing unit depending on the intended purpose.

Charge elimination is preferably performed by, for example, applying a charge-eliminating bias to the latent image bearing member with a charge-eliminating unit. The charge-eliminating unit is not particularly limited, so long as it can apply a charge-eliminating bias to the latent image bearing member, and may be appropriately selected from known charge-eliminating devices. Preferably, a charge-eliminating lamp or a similar device is used.

Cleaning is preferably performed by, for example, removing the toner remaining on the photoconductor with a cleaning unit. The cleaning unit is not particularly limited, so long as it can remove the toner remaining on the photoconductor, and may be appropriately selected from known cleaners. Preferred examples thereof include a magnetic blush cleaner, an electrostatic brush cleaner, a magnetic roller cleaner, a blade cleaner, a brush cleaner and a web cleaner.

Recycling is preferably performed by, for example, conveying the toner having been removed by the cleaning unit to the developing unit with a recycling unit. The recycling unit is not particularly limited and may be, for example, a known conveying unit.

Control is preferably performed by, for example, controlling each unit with a controlling unit. The controlling unit is not particularly limited, so long as it can control each unit, and may be appropriately selected depending on the intended purpose. Examples thereof include devices such as a sequencer and a computer.

The image forming apparatus, image forming method or process cartridge of the present invention uses the latent electrostatic image developing toner excellent in fixing property and involving no degradation (e.g., cracks) due to stress in the developing process, and thus can provide good images.

Figure 5:
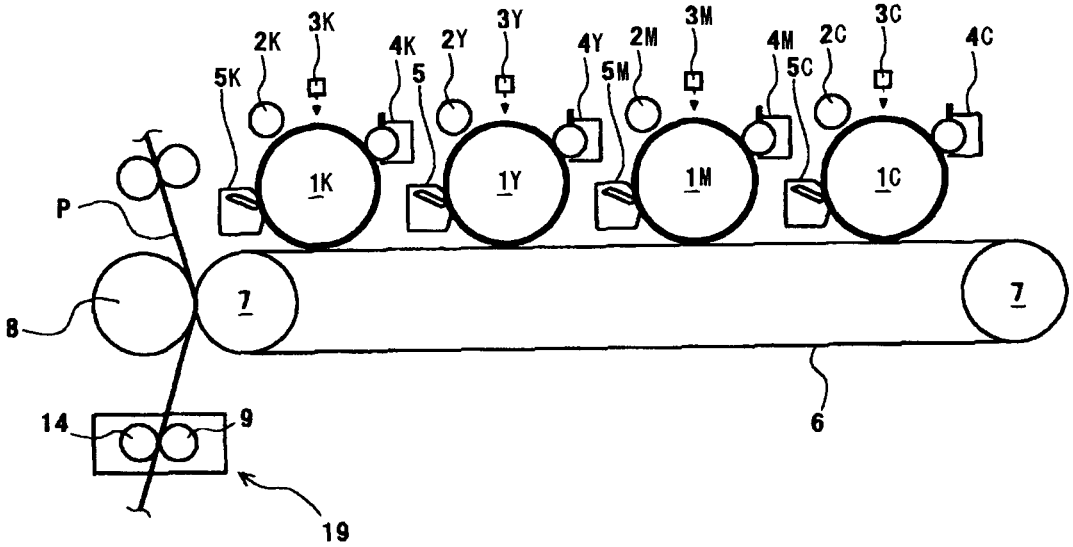
FIG. 5 is a cross-sectional schematic view of another exemplary image forming apparatus according to an embodiment of the present invention.

FIG. 5 is a schematic view of an example of a multi-color image forming apparatus to which the present invention is applied. The multi-color image forming apparatus illustrated in FIG. 5 is a tandem-type full color image forming apparatus.

The image forming apparatus of FIG. 5 contains, in an unillustrated main body casing, latent image bearing members (1) rotated clockwise in FIG. 5 which are each provided therearound with a charging device (2), an exposing device (3), a developing device (4), an intermediate transfer medium (6), a supporting roller (7), a transfer roller (8), and other members. This image forming apparatus has an unillustrated paper-feeding cassette containing a plurality of recording paper sheets. The recording paper sheets (P) in the paper-feeding cassette are fed one by one with an unillustrated paper-feeding roller to between the intermediate transfer medium (6) and the transfer roller (8), followed by fixing with a fixing unit (19). Before fed to therebetween, the recording paper sheet is retained with a pair of registration rollers so that it can be fed at a desired timing.

In this image forming apparatus, while being rotated clockwise in FIG. 5, each of the latent image bearing members (1) is uniformly charged with the corresponding charging unit (2). Then, the latent image bearing member (1) is irradiated with laser beams modulated by image date from the corresponding exposing unit (3), to thereby form a latent electrostatic image. The latent electrostatic image formed on the latent image bearing member (1) is developed with the toner using the corresponding developing unit (4). Next, the toner image, which has formed by applying the toner to the latent image bearing member with the developing unit (4), is transferred from the latent image bearing member (1) to the intermediate transfer medium. The above-described process is performed in four colors of cyan (C), magenta (M), yellow (Y) and black (K), to thereby form a full color toner image.

Figure 6:
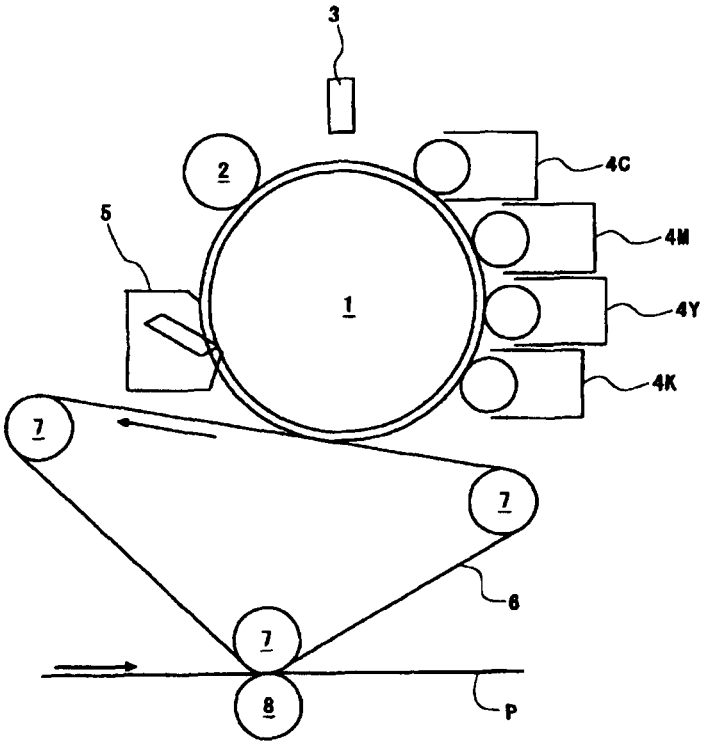
FIG. 6 is a cross-sectional schematic view of another exemplary image forming apparatus according to an embodiment of the present invention.

FIG. 6 is a schematic view of an example of a full color image forming apparatus of a revolver type. This image forming apparatus switches the operation of each developing unit to sequentially apply color toners onto one latent image bearing member (1) for development. A transfer roller (8) is used to transfer the color toner image from the intermediate transfer medium (6) onto a recording paper sheet (P), which is then conveyed to a fixing part for obtaining a fixed image.

In the image forming apparatus after the toner image has been transferred from the intermediate transfer member (6) onto the recording paper sheet (P), the latent image bearing member (1) is further rotated to reach a cleaning unit (5) where the toner remaining on the surface of the latent image bearing member (1) is scraped off by a blade, followed by charge-eliminating. Then, the image forming apparatus uniformly charges, with the charging device (2), the latent image bearing member (1) charge-eliminated by the charge-eliminating device, and performs the next image formation in the same manner as described above. Notably, the cleaning part (5) is limited to the part where the toner remaining on the latent image bearing member (1) is scraped off by a blade. For example, the cleaning part (5) may be a part where the toner remaining on the latent image bearing member (1) is scraped off by a fur brush.

The image forming method or image forming apparatus of the present invention uses as a developer the toner of the present invention, and thus can provide good images.

<Process Cartridge>

A process cartridge of the present invention includes a latent image bearing member which bears a latent image thereon, and a developing unit configured to develop, with a toner of the present invention, a latent electrostatic image formed on the surface of the latent image bearing member, to thereby form a visible image on the surface of the latent image bearing member; and, if necessary, further includes appropriately selected other units such as a charging unit, a developing unit, a transfer unit, a cleaning unit, and a charge-eliminating unit.

The process cartridge is mounted detachably to the main body of an image forming apparatus.

The developing unit has at least a developer container housing the toner or the developer of the present invention, and a developer bearing member which bears and conveys the toner or the developer housed in the developer container; and optionally includes, for example, a layer thickness-regulating member for regulating the layer thickness of the toner on the developer bearing member. The process cartridge of the present invention can be mounted detachably to various electrophotographic apparatuses, facsimiles and printers. Preferably, it is mounted detachably to the image forming apparatus of the present invention.

Figure 7:
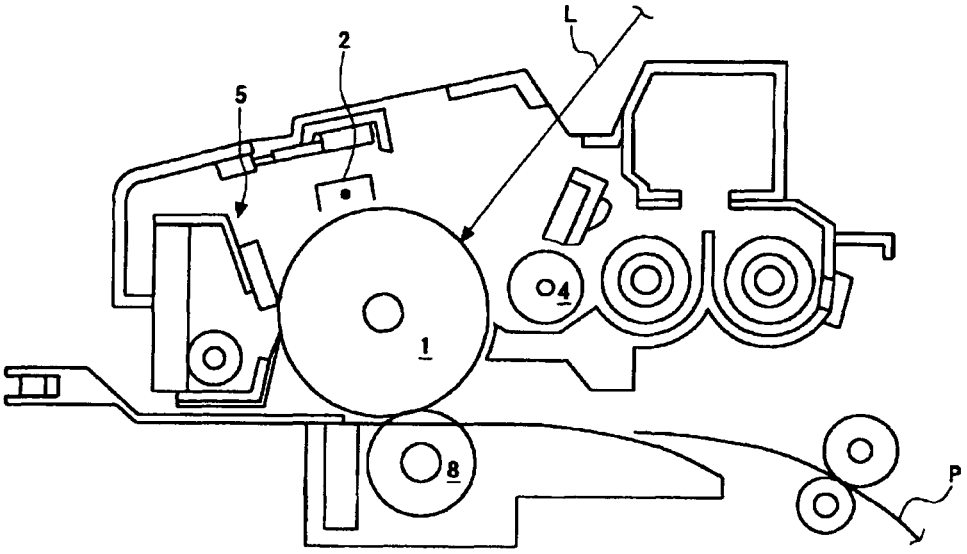
FIG. 7 is a cross-sectional schematic view of one exemplary process cartridge of the present invention.

As illustrated in FIG. 7, the process cartridge includes a latent image bearing member (1), a charging unit (2), a developing unit (4), a transfer roller (8) and a cleaning unit (5); and, if necessary, further includes other units. In FIG. 7, (L) denotes light emitted from an unillustrated exposing unit and (P) denotes a recording paper sheet. The latent image bearing member (1) may be the same as that used in the above-described image forming apparatus. The charging unit (2) may be any charging member.

Next, description will be given to image forming process by the process cartridge illustrated in FIG. 7. While being rotated clockwise, the latent image bearing member (1) is charged with the charging unit (2) and then is exposed to light (L) emitted from the unillustrated exposing unit. As a result, a latent electrostatic image in response to an exposure pattern is formed on the surface of the latent image bearing member (1). The latent electrostatic image is developed with the toner in the developing device (4). The developed toner image is transferred with the transfer roller (8) onto the recording paper sheet (P), which is then printed out. Next, the latent image bearing member surface from which the toner image has been transferred is cleaned in the cleaning unit (5), and is charge-eliminated with an unillustrated charge-eliminating unit. The above-described process is repeatedly performed.

EXAMPLES

The present invention will next be described by way of Examples, which should not be construed as limiting the present invention thereto.

<Preparation Method of Resin Dispersion Liquid 1>

A reaction container equipped with a condenser, a stirrer and a nitrogen-introducing pipe was charged with sodium lauryl sulfate (0.7 parts by mass) and ion-exchange water (498 parts by mass), followed by heating to 80° C. under heating for dissolution. Then, a solution of potassium persulfate (2.6 parts by mass) in ion-exchange water (104 parts by mass) was added to the resultant solution. Fifteen minutes after the addition, a monomer mixture of a styrene monomer (200 parts by mass) and n-octanethiol (4.2 parts by mass) was added dropwise to the resultant mixture for 90 min. Subsequently, the temperature of the mixture was maintained at 80° C. for 60 min to perform polymerization reaction.

Then, the reaction mixture was cooled to obtain white [resin dispersion liquid 1] having a volume average particle diameter of 135 nm. Subsequently, 2 mL of the thus-obtained [resin dispersion liquid 1] was added to a Petri dish, where the dispersion medium was evaporated. The obtained dry product was measured for number average molecular weight, weight average molecular weight and Tg, which were found to be 8,300, 16,900 and 83° C., respectively.

<Preparation Method of Resin Dispersion Liquid 2>

A reaction container equipped with a condenser, a stirrer and a nitrogen-introducing pipe was charged with sodium lauryl sulfate (0.7 parts by mass) and ion-exchange water (498 parts by mass), followed by heating to 80° C. under heating for dissolution. Then, a solution of potassium persulfate (2.6 parts by mass) in ion-exchange water (104 parts by mass) was added to the resultant solution. Fifteen minutes after the addition, a monomer mixture of a styrene monomer (170 parts by mass), butyl acrylate (30 parts by mass) and n-octanethiol (4.2 parts by mass) was added dropwise to the resultant mixture for 90 min. Subsequently, the temperature of the mixture was maintained at 80° C. for 60 min to perform polymerization reaction.

Then, the reaction mixture was cooled to obtain white [resin dispersion liquid 2] having a volume average particle diameter of 135 nm. Subsequently, 2 mL of the thus-obtained [resin dispersion liquid 2] was added to a Petri dish, where the dispersion medium was evaporated. The obtained dry product was measured for number average molecular weight, weight average molecular weight and Tg, which were found to be 8,600, 17,300 and 55° C., respectively.

<Preparation Method of Resin Dispersion Liquid 3>

A reaction container equipped with a condenser, a stirrer and a nitrogen-introducing pipe was charged with sodium lauryl sulfate (0.7 parts by mass) and ion-exchange water (498 parts by mass), followed by heating to 80° C. under heating for dissolution. Then, a solution of potassium persulfate (2.7 parts by mass) in ion-exchange water (108 parts by mass) was added to the resultant solution. Fifteen minutes after the addition, a monomer mixture of a styrene monomer (196 parts by mass), methacrylic acid (4 parts by mass), and n-octanethiol (4.2 parts by mass) was added dropwise to the resultant mixture for 90 min. Subsequently, the temperature of the mixture was maintained at 80° C. for 60 min to perform polymerization reaction.

Then, the reaction mixture was cooled to obtain white [resin dispersion liquid 3] having a volume average particle diameter of 117 nm. Subsequently, 2 mL of the thus-obtained [resin dispersion liquid 3] was added to a Petri dish, where the dispersion medium was evaporated. The obtained dry product was measured for number average molecular weight, weight average molecular weight and Tg, which were found to be 8,900, 31,000 and 61° C., respectively.

<Preparation of Resin Dispersion Liquid 4>

A reaction container equipped with a condenser, a stirrer and a nitrogen-introducing pipe was charged with sodium lauryl sulfate (0.7 parts by mass) and ion-exchange water (498 parts by mass), followed by heating to 80° C. under heating for dissolution. Then, a solution of potassium persulfate (2.5 parts by mass) in ion-exchange water (98 parts by mass) was added to the resultant solution. Fifteen minutes after the addition, a monomer mixture of a styrene monomer (160 parts by mass) and [compound 1] having the following chemical formula (40 parts by mass) was added dropwise to the resultant mixture for 90 min. Subsequently, the temperature of the mixture was maintained at 80° C. for 60 min to perform polymerization reaction.

Then, the reaction mixture was cooled to obtain white [resin dispersion liquid 4] having a volume average particle diameter of 115 nm. Subsequently, 2 mL of the thus-obtained [resin dispersion liquid 4] was added to a Petri dish, where the dispersion medium was evaporated. The obtained dry product was measured for number average molecular weight, weight average molecular weight and Tg, which were found to be 98,400, 421,900 and 70° C., respectively.

compound 1

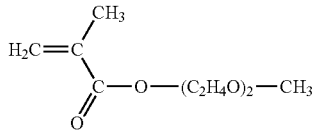

<Preparation Method of Resin Dispersion Liquid 5>

A reaction container equipped with a condenser, a stirrer and a nitrogen-introducing pipe was charged with sodium lauryl sulfate (0.7 parts by mass) and ion-exchange water (498 parts by mass), followed by heating to 80° C. under heating for dissolution. Then, a solution of potassium persulfate (2.7 parts by mass) in ion-exchange water (108 parts by mass) was added to the resultant solution. Fifteen minutes after the addition, a monomer mixture of a styrene monomer (160 parts by mass) and methyl methacrylate (40 parts by mass) was added dropwise to the resultant mixture for 90 min. Subsequently, the temperature of the mixture was maintained at 80° C. for 60 min to perform polymerization reaction.

Then, the reaction mixture was cooled to obtain white [resin dispersion liquid 5] having a volume average particle diameter of 100 nm. Subsequently, 2 mL of the thus-obtained [resin dispersion liquid 5] was added to a Petri dish, where the dispersion medium was evaporated. The obtained dry product was measured for number average molecular weight, weight average molecular weight and Tg, which were found to be 60,000, 215,500 and 99° C., respectively.

<Preparation Method of Resin Dispersion Liquid 6>

A reaction container equipped with a condenser, a stirrer and a nitrogen-introducing pipe was charged with sodium lauryl sulfate (0.7 parts by mass) and ion-exchange water (498 parts by mass), followed by heating to 80° C. under heating for dissolution. Then, a solution of potassium persulfate (2.5 parts by mass) in ion-exchange water (101 parts by mass) was added to the resultant solution. Fifteen minutes after the addition, a monomer mixture of a styrene monomer (170 parts by mass) and butyl acrylate (30 parts by mass) was added dropwise to the resultant mixture for 90 min. Subsequently, the temperature of the mixture was maintained at 80° C. for 60 min to perform polymerization reaction.

Then, the reaction mixture was cooled to obtain white [resin dispersion liquid 6] having a volume average particle diameter of 113 nm. Subsequently, 2 mL of the thus-obtained [resin dispersion liquid 6] was added to a Petri dish, where the dispersion medium was evaporated. The obtained dry product was measured for number average molecular weight, weight average molecular weight and Tg, which were found to be 68,700, 317,600 and 75° C., respectively.

<Preparation Method of Resin Dispersion Liquid 7>

A reaction container equipped with a condenser, a stirrer and a nitrogen-introducing pipe was charged with sodium lauryl sulfate (0.7 parts by mass) and ion-exchange water (498 parts by mass), followed by heating to 80° C. under heating for dissolution. Then, a solution of potassium persulfate (2.6 parts by mass) in ion-exchange water (102 parts by mass) was added to the resultant solution. Fifteen minutes after the addition, a monomer mixture of a styrene monomer (184.6 parts by mass), butyl acrylate (15 parts by mass) and divinyl benzene (0.5 parts by mass) was added dropwise to the resultant mixture for 90 min. Subsequently, the temperature of the mixture was maintained at 80° C. for 60 min to perform polymerization reaction.

Then, the reaction mixture was cooled to obtain white [resin dispersion liquid 7] having a volume average particle diameter of 79 nm. Subsequently, 2 mL of the thus-obtained [resin dispersion liquid 7] was added to a Petri dish, where the dispersion medium was evaporated. The obtained dry product was measured for number average molecular weight, weight average molecular weight and Tg, which were found to be 33,900, 160,800 and 87° C., respectively.

<Preparation Method of Resin Dispersion Liquid 8>

A reaction container equipped with a condenser, a stirrer and a nitrogen-introducing pipe was charged with sodium lauryl sulfate (0.7 parts by mass) and ion-exchange water (498 parts by mass), followed by heating to 80° C. under heating for dissolution. Then, a solution of potassium persulfate (2.5 parts by mass) in ion-exchange water (101 parts by mass) was added to the resultant solution. Fifteen minutes after the addition, a monomer mixture of a styrene monomer (169 parts by mass), butyl acrylate (30 parts by mass) and divinyl benzene (1 part by mass) was added dropwise to the resultant mixture for 90 min. Subsequently, the temperature of the mixture was maintained at 80° C. for 60 min to perform polymerization reaction.

Then, the reaction mixture was cooled to obtain white [resin dispersion liquid 8] having a volume average particle diameter of 100 nm. Subsequently, 2 mL of the thus-obtained [resin dispersion liquid 8] was added to a Petri dish, where the dispersion medium was evaporated. The obtained dry product was measured for number average molecular weight, weight average molecular weight and Tg, which were found to be 31,300, 88,300 and 75° C., respectively.

<Preparation Method of Resin Dispersion Liquid 9>

A polyester resin dispersion liquid RTP-2 (product of TOYOBO CO., LTD.) was used as [resin dispersion liquid 9].

<Preparation Method of Resin Dispersion Liquid 10>

A reaction container equipped with a condenser, a stirrer and a nitrogen-introducing pipe was charged with sodium lauryl sulfate (0.7 parts by mass) and ion-exchange water (498 parts by mass), followed by heating to 80° C. under heating for dissolution. Then, a solution of potassium persulfate (2.5 parts by mass) in ion-exchange water (98 parts by mass) was added to the resultant solution. Fifteen minutes after the addition, a monomer mixture of a styrene monomer (130 parts by mass) and [compound 1] (70 parts by mass) was added dropwise to the resultant mixture for 90 min. Subsequently, the temperature of the mixture was maintained at 80° C. for 60 min to perform polymerization reaction.

Then, the reaction mixture was cooled to obtain white [resin dispersion liquid 10] having a volume average particle diameter of 115 nm. Subsequently, 2 mL of the thus-obtained [resin dispersion liquid 10] was added to a Petri dish, where the dispersion medium was evaporated. The obtained dry product was measured for number average molecular weight, weight average molecular weight and Tg, which were found to be 87,600, 391,700 and 48° C., respectively.

<Preparation Method of Resin Dispersion Liquid 11>

A reaction container equipped with a condenser, a stirrer and a nitrogen-introducing pipe was charged with sodium lauryl sulfate (0.7 parts by mass) and ion-exchange water (498 parts by mass), followed by heating to 80° C. under heating for dissolution. Then, a solution of potassium persulfate (2.8 parts by mass) in ion-exchange water (111 parts by mass) was added to the resultant solution. Fifteen minutes after the addition, a monomer mixture of a styrene monomer (130 parts by mass) and methyl methacrylate (70 parts by mass) was added dropwise to the resultant mixture for 90 min. Subsequently, the temperature of the mixture was maintained at 80° C. for 60 min to perform polymerization reaction.

Then, the reaction mixture was cooled to obtain white [resin dispersion liquid 11] having a volume average particle diameter of 122 nm. Subsequently, 2 mL of the thus-obtained [resin dispersion liquid 11] was added to a Petri dish, where the dispersion medium was evaporated. The obtained dry product was measured for number average molecular weight, weight average molecular weight and Tg, which were found to be 61,900, 183,500 and 99° C., respectively.

(Production Method of Polymerized Toner)

<Synthesis of Polyester 1>

A reaction container equipped with a condenser, a stirrer and a nitrogen-introducing pipe was charged with bisphenol A ethylene oxide 2 mol adduct (229 parts by mass), bisphenol A propylene oxide 3 mol adduct (529 parts by mass), terephthalic acid (208 parts by mass), adipic acid (46 parts by mass) and dibutyl tinoxide (2 parts by mass), followed by reaction at 230° C. for 8 hours under normal pressure. Next, the reaction mixture was allowed to react for 5 hours under a reduced pressure of 10 mmHg to 15 mmHg. Then, trimellitic anhydride (44 parts by mass) was added to the reaction container, followed by reaction at 180° C. for 2 hours under normal pressure, to thereby synthesize [polyester 1]. The thus-obtained [polyester 1] was found to have a number average molecular weight of 2,500, a weight average molecular weight of 6,700, a glass transition temperature of 43° C. and an acid value of 25 mgKOH/g.

<Synthesis of Polyester 2>

A reaction container equipped with a condenser, a stirrer and a nitrogen-introducing pipe was charged with bisphenol A ethylene oxide 2 mol adduct (264 parts by mass), bisphenol A propylene oxide 2 mol adduct (523 parts by mass), terephthalic acid (123 parts by mass), adipic acid (173 parts by mass) and dibutyl tinoxide (1 part by mass), followed by reaction at 230° C. for 8 hours under normal pressure. Next, the reaction mixture was allowed to react for 8 hours under a reduced pressure of 10 mmHg to 15 mmHg. Then, trimellitic anhydride (26 parts by mass) was added to the reaction container, followed by reaction at 180° C. for 2 hours under normal pressure, to thereby systhesize [polyester 2]. The thus-obtained [polyester 2] was found to have a number average molecular weight of 4,000, a weight average molecular weight of 47,000, a glass transition temperature of 65° C. and an acid value of 12 mgKOH/g.

—Synthesis of Isocyanate-Modified Polyester 1—

A reaction container equipped with a condenser, a stirrer and a nitrogen-introducing pipe was charged with bisphenol A ethylene oxide 2 mol adduct (682 parts by mass), bisphenol A propylene oxide 2 mol adduct (81 parts by mass), terephthalic acid (283 parts by mass), trimillitic anhydride (22 parts by mass) and dibutyl tinoxide (2 parts by mass), followed by reaction at 230° C. for 8 hours under normal pressure. Next, the reaction mixture was allowed to react for 5 hours under a reduced pressure of 10 mmHg to 15 mmHg, to thereby synthesize [intermediate polyester 1]. The thus-obtained [intermediate polyester 1] was found to have a number average molecular weight of 2,200, a weight average molecular weight of 9,700, a glass transition temperature of 54° C., an acid value of 0.5 mgKOH/g and a hydroxyl value of 52 mgKOH/g.

Next, a reaction container equipped with a condenser, a stirrer and a nitrogen-introducing pipe was charged with [intermediate polyester 1] (410 parts by mass), isophorone diisocyanate (89 parts by mass) and ethyl acetate (500 parts by mass), followed by reaction at 100° C. for 5 hours, to thereby obtain [isocyanate-modified polyester 1].

—Preparation of Masterbatch—

Carbon black (REGAL 400R, product of Cabot Corporation) (40 parts by mass), a binder resin (polyester resin) (60 parts by mass) (RS-801, product of Sanyo Chemical Industries, Ltd., acid value: 10 mgKOH/g, weight average molecular weight: 20,000, Tg: 64° C.) and water (30 parts by mass) were mixed together using HENSCHEL MIXER, to thereby obtain a mixture containing pigment aggregates impregnated with water. The obtained mixture was kneaded for 45 min with a two-roll mill whose roll surface temperature had been adjusted to 130° C. The kneaded product was pulverized with a pulverizer so as to have a size of 1 mm, whereby [masterbatch 1] was obtained.

Example 1

Preparation Step of Oil Phase

A container to which a stirring rod and a thermometer had been set was charged with [polyester 1] (545 parts by mass), [paraffin wax (melting point: 74° C.)] (181 parts by mass) and ethyl acetate (1,450 parts by mass). The mixture was increased in temperature to 80° C. under stirring, maintained at 80° C. for 5 hours, and cooled to 30° C. for 1 hour. Then, the container was charged with [masterbatch 1] (500 parts by mass) and ethyl acetate (100 parts by mass), followed by mixing for 1 hour, to thereby obtain [raw material solution 1].

[Raw material solution 1] (1,500 parts by mass) was placed in a container, where the pigment and the wax were dispersed with a bead mill ("ULTRA VISCOMILL," product of AIMEX CO., Ltd.) under the following conditions: a liquid feed rate of 1 kg/hr, disc circumferential velocity of 6 m/s, 0.5 mm-zirconia beads packed to 80% by volume, and 3 passes. Next, a 66% by mass ethyl acetate solution of [polyester 2] (655 parts by mass) was added thereto, and passed once with the bead mill under the above conditions, to thereby obtain [pigment/wax dispersion liquid 1].

[Pigment/wax dispersion liquid 1] (976 parts by mass) was mixed for 1 min at 5,000 rpm with a TK homomixer (product of Tokushu Kika Kogyo Co., Ltd.). Then, [isocyanate-modified polyester 1] (88 parts by mass) was added to [pigment/wax dispersion liquid 1]. The resultant mixture was mixed for 1 min at 5,000 rpm with a TK homomixer (product of Tokushu Kika Kogyo Co., Ltd.), to thereby obtain [oil phase 1]. Through measurement, the solid content of [oil phase 1] was found to be 52.0% by mass, and the amount of ethyl acetate in the solid content was found to be 92% by mass.

<Preparation of Aqueous Phase>

Ion-exchange water (970 parts by mass), 40 parts by mass of 25% aqueous dispersion liquid of fine organic resin particles for stabilizing dispersion (a copolymer of styrene-methacrylic acid-butyl methacrylate-sodium salt of methacrylic acid ethylene oxide adduct sulfuric acid ester), 95 parts by mass of 48.5% aqueous solution of sodium dodecyl diphenyl ether disulfonate and 98 parts by mass of ethyl acetate were mixed together under stirring. The resultant mixture was found to have a pH of 6.2. Then, 10% aqueous solution of sodium hydroxide was added dropwise thereto to adjust the pH to 9.5, whereby [aqueous phase 1] was obtained.

<Production Step of Toner Core Particles>

The obtained [aqueous phase 1] (1,200 parts by mass) was added to [oil phase 1]. The resultant mixture was mixed for 2 min with a TK homomixer at 8,000 rpm to 15,000 rpm, while being adjusted to 20° C. to 23° C. in a water bath to suppress increase in temperature due to shear heat of the mixer. Thereafter, the mixture was stirred for 10 min at 130 rpm to 350 rpm using a three-one motor equipped with an anchor wing, to thereby obtain [toner core particle slurry 1] containing liquid droplets of the oil phase (core particles) in the aqueous phase.

<Formation of Protrusions>

First, [resin dispersion liquid 1] (106 parts by mass) was mixed with ion-exchange water (71 parts by mass). The resultant mixture (solid concentration: 15%) was added dropwise for 3 min to [toner core particle slurry 1] whose temperature was adjusted to 22° C. This addition was performed while [toner core particle slurry 1] was being stirred at 130 rpm to 350 rpm with a three-one motor equipped with an anchor wing. Thereafter, the mixture was further stirred for 30 min at 200 rpm to 450 rpm to obtain [toner base particle slurry 1]. Then, 1 mL of [toner base particle slurry 1] was diluted so as to have a volume of 10 mL, followed by centrifugation, whereby a transparent supernatant was obtained.

<Desolvation>

A container to which a stirrer and a thermometer had been set was charged with [toner base particle slurry 1], which was desolvated with stirring at 30° C. for 8 hours to obtain [dispersion slurry 1]. A small amount of [dispersion slurry 1] was placed on a glass slide, and observed through a cover glass under an optical microscope (×200). As a result, uniform colored particles were observed. Also, 1 mL of [dispersion slurry 1] was diluted so as to have a volume of 10 mL, followed by centrifugation, whereby a transparent supernatant was obtained.

<Washing and Drying Step>

After [dispersion slurry 1] (100 parts by mass) had been filtrated under reduced pressure, the following treatments (1) to (4) were performed.

(1) Ion-exchange water (100 parts by mass) was added to the filtration cake, followed by mixing with a TK homomixer (at 12,000 rpm for 10 min) and filtrating.

(2) Ion-exchange water (900 parts by mass) was added to the filtration cake obtained in (1). The resultant mixture was mixed with a TK homomixer (at 12,000 rpm for 30 min) under application of ultrasonic vibration, followed by filtrating under reduced pressure. This treatment was repeated until the reslurry had an electrical conductivity of 10 μC/cm or lower.

(3) 10% hydrochloric acid was added to the reslurry obtained in (2) so as to have a pH of 4, followed by stirring for 30 min with a three-one motor and filtrating.

(4) Ion-exchange water (100 parts by mass) was added to the filtration cake obtained in (3), followed by mixing with a TK homomixer (at 12,000 rpm for 10 min) and filtrating. This treatment was repeated until the reslurry had an electrical conductivity of 10 μC/cm or lower, to thereby obtain [filtration cake 1].

Figure 2A:
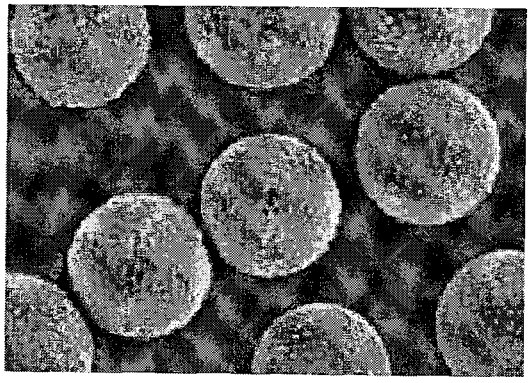
FIG. 2A is a scanning electron microscope (SEM) image of toner base particles produced in Example 1.

[Filtration cake 1] was dried with an air-circulation dryer at 45° C. for 48 hours, and then sieved with a mesh having an opening size of 75 μm to obtain [toner base particle 1]. After beating aggregated [toner base particle 1] using HENSHEL MIXER, through observation of the obtained [toner base particle 1] under a scanning electron microscope, the vinyl resin was found to be uniformly attached to the surfaces of the toner core particles as illustrated in FIG. 2A.

To [toner base particle 1] (100 parts by mass), commercially available silica fine powder H20™ (1.5 parts by mass) (product of Clariant (Japan) K.K.; average primary particle diameter: 12 nm, without silicone oil treatment), and RY50 (2.8 parts by mass) (product of Nippon Aerosil Co., Ltd.; average primary particle diameter: 40 nm, with silicone oil treatment) were added and mixed together using HENSCHEL MIXER. The resultant mixture was caused to pass through a sieve with an opening size of 60 μm to remove coarse particles and aggregates, whereby [toner 1] was obtained.

Example 2

[Toner 2] was obtained in the same manner as in Example 1, except that after beating aggregated [toner base particle 1] using HENSHEL MIXER, to [toner base particle 1] (100 parts by mass), commercially available silica fine powder H20™ (1.5 parts by mass) (product of Clariant (Japan) K.K.; average primary particle diameter: 12 nm, without silicone oil treatment), RY50 (2.8 parts by mass) (product of Nippon Aerosil Co., Ltd.; average primary particle diameter: 40 nm, with silicone oil treatment), and MSP-009 (0.8 parts by mass) (product of Tayca Corporation, average primary particle diameter: 80 nm, with silicone oil treatment) were added and mixed together using HENSCHEL MIXER, and the resultant mixture was caused to pass through a sieve with an opening size of 60 μm to remove coarse particles and aggregates.

Example 3

[Toner 3] was obtained in the same manner as in Example 1, except that after beating aggregated [toner base particle 1] using HENSHEL MIXER, to [toner base particle 1] (100 parts by mass), commercially available silica fine powder NY50 (1.5 parts by mass) (product of Nippon Aerosil Co., Ltd.; average primary particle diameter: 30 nm, with silicone oil treatment) was added and mixed together using HENSCHEL MIXER, and the resultant mixture was caused to pass through a sieve with an opening size of 60 μm to remove coarse particles and aggregates.

Example 4

[Toner 4] was obtained in the same manner as in Example 1, except that after beating aggregated [toner base particle 1] using HENSHEL MIXER, to [toner base particle 1] (100 parts by mass), commercially available silica fine powder RY200 (1.5 parts by mass) (product of Nippon Aerosil Co., Ltd.; average primary particle diameter: 12 nm, with silicone oil treatment), and RY50 (2.8 parts by mass) (product of Nippon Aerosil Co., Ltd.; average primary particle diameter: 40 nm, with silicone oil treatment) were added and mixed together using HENSCHEL MIXER, and the resultant mixture was caused to pass through a sieve with an opening size of 60 μm to remove coarse particles and aggregates.

Example 5

[Toner 5] was obtained in the same manner as in Example 1, except that after beating aggregated [toner base particle 1] using HENSHEL MIXER, to [toner base particle 1] (100 parts by mass), commercially available silica fine powder RY200S (1.5 parts by mass) (product of Nippon Aerosil Co., Ltd.; average primary particle diameter: 16 nm, with silicone oil treatment), and RY50 (2.8 parts by mass) (product of Nippon Aerosil Co., Ltd.; average primary particle diameter: 40 nm, with silicone oil treatment) were added and mixed together using HENSCHEL MIXER, and the resultant mixture was caused to pass through a sieve with an opening size of 60 μm to remove coarse particles and aggregates.

Example 6

[Toner 6] was obtained in the same manner as in Example 1, except that after beating aggregated [toner base particle 1] using HENSHEL MIXER, to [toner base particle 1] (100 parts by mass), commercially available silica fine powder H20TD (1.5 parts by mass) (product of Clariant (Japan) K.K.;

average primary particle diameter: 12 nm, with silicone oil treatment) and RY50 (2.8 parts by mass) (product of Nippon Aerosil Co., Ltd.; average primary particle diameter: 40 nm, with silicone oil treatment) were added and mixed together using HENSCHEL MIXER, and the resultant mixture was caused to pass through a sieve with an opening size of 60 μm to remove coarse particles and aggregates.

Example 7

[Toner 7] was obtained in the same manner as in Example 1, except that after beating aggregated [toner base particle 1] using HENSHEL MIXER, to [toner base particle 1] (100 parts by mass), commercially available silica fine powder RY200 (1.5 parts by mass) (product of Nippon Aerosil Co., Ltd.; average primary particle diameter: 12 nm, with silicone oil treatment), and RX50 (2.8 parts by mass) (product of Nippon Aerosil Co., Ltd.; average primary particle diameter: 40 nm, without silicone oil treatment) were added and mixed together using HENSCHEL MIXER, and the resultant mixture was caused to pass through a sieve with an opening size of 60 μm to remove coarse particles and aggregates.

Example 8

[Toner 8] was obtained in the same manner as in Example 1, except that after beating aggregated [toner base particle 1] using HENSHEL MIXER, to [toner base particle 1] (100 parts by mass), commercially available silica fine powder RY200 (1.5 parts by mass) (product of Nippon Aerosil Co., Ltd.; average primary particle diameter: 12 nm, with silicone oil treatment) was added and mixed together using HENSCHEL MIXER, and the resultant mixture was caused to pass through a sieve with an opening size of 60 μm to remove coarse particles and aggregates.

Example 9

[Toner 9] was obtained in the same manner as in Example 1, except that after beating aggregated [toner base particle 1] using HENSHEL MIXER, to [toner base particle 1] (100 parts by mass), commercially available silica fine powder RY50 (2.8 parts by mass) (product of Nippon Aerosil Co., Ltd.; average primary particle diameter: 40 nm, with silicone oil treatment) was added and mixed together using HENSCHEL MIXER, and the resultant mixture was caused to pass through a sieve with an opening size of 60 μm to remove coarse particles and aggregates.

Example 10

[Toner 10] was obtained in the same manner as in Example 1, except that after beating aggregated [toner base particle 1] using HENSHEL MIXER, to [toner base particle 1] (100 parts by mass), commercially available silica fine powder H20™ (1.5 parts by mass) (product of Clariant (Japan) K.K.; average primary particle diameter: 12 nm, without silicone oil treatment) and RY50 (5.6 parts by mass) (product of Nippon Aerosil Co., Ltd.; average primary particle diameter: 40 nm, with silicone oil treatment) were added and mixed together using HENSCHEL MIXER, and the resultant mixture was caused to pass through a sieve with an opening size of 60 μm to remove coarse particles and aggregates.

Example 11

[Toner 11] was obtained in the same manner as in Example 1, except that after beating aggregated [toner base particle 1] using HENSHEL MIXER, to [toner base particle 1] (100 parts by mass), commercially available silica fine powder RY200 (5.0 parts by mass) (product of Nippon Aerosil Co., Ltd.; average primary particle diameter: 12 nm, with silicone oil treatment) and RX50 (2.8 parts by mass) (product of Nippon Aerosil Co., Ltd.; average primary particle diameter: 40 nm, without silicone oil treatment) were added and mixed together using HENSCHEL MIXER, and the resultant mixture was caused to pass through a sieve with an opening size of 60 μm to remove coarse particles and aggregates.

Example 12

[Toner 12] was obtained in the same manner as in Example 1, except that after beating aggregated [toner base particle 1] using HENSHEL MIXER, to [toner base particle 1] (100 parts by mass), commercially available silica fine powder H20™ (1.5 parts by mass) (product of Clariant (Japan) K.K.; average primary particle diameter: 12 nm, without silicone oil treatment) and RY50 (0.7 parts by mass) (product of Nippon Aerosil Co., Ltd.; average primary particle diameter: 40 nm, with silicone oil treatment) were added and mixed together using HENSCHEL MIXER, and the resultant mixture was caused to pass through a sieve with an opening size of 60 μm to remove coarse particles and aggregates.

Example 13

[Toner 13] was obtained in the same manner as in Example 1, except that after beating aggregated [toner base particle 1] using HENSHEL MIXER, to [toner base particle 1] (100 parts by mass), commercially available silica fine powder RY200 (0.7 parts by mass) (product of Nippon Aerosil Co., Ltd.; average primary particle diameter: 12 nm, with silicone oil treatment) and RX50 (2.8 parts by mass) (product of Nippon Aerosil Co., Ltd.; average primary particle diameter: 40 nm, without silicone oil treatment) were added and mixed together using HENSCHEL MIXER, and the resultant mixture was caused to pass through a sieve with an opening size of 60 μm to remove coarse particles and aggregates.

Example 14

[Toner base particle 14] was obtained in the same manner as in Example 1, except that [resin dispersion liquid 1] was changed to [resin dispersion liquid 2]. After beating aggregated [toner base particle 14] using HENSHEL MIXER, through observation of the obtained [toner base particle 14] under a scanning electron microscope, the vinyl resin was found to be uniformly fused with the surfaces of the toner core particles. To [toner base particle 14] (100 parts by mass), commercially available silica fine powder H20™ (1.5 parts by mass) (product of Clariant (Japan) K.K.; average primary particle diameter: 12 nm, without silicone oil treatment) and RY50 (2.8 parts by mass) (product of Nippon Aerosil Co., Ltd.; average primary particle diameter: 40 nm, with silicone oil treatment) were added and mixed together using HENSCHEL MIXER, and the resultant mixture was caused to pass through a sieve with an opening size of 60 μm to remove coarse particles and aggregates, whereby [toner 14] was obtained.

Example 15

[Toner base particle 15] was obtained in the same manner as in Example 1, except that [resin dispersion liquid 1] was changed to [resin dispersion liquid 3]. After beating aggregated [toner base particle 15] using HENSHEL MIXER, through observation of the obtained [toner base particle 15] under a scanning electron microscope, the vinyl resin was found to be uniformly fused with the surfaces of the toner core particles. To [toner base particle 15] (100 parts by mass), commercially available silica fine powder H20™ (1.5 parts by mass) (product of Clariant (Japan) K.K.; average primary particle diameter: 12 nm, without silicone oil treatment) and RY50 (2.8 parts by mass) (product of Nippon Aerosil Co., Ltd.; average primary particle diameter: 40 nm, with silicone oil treatment) were added and mixed together using HENSCHEL MIXER, and the resultant mixture was caused to pass through a sieve with an opening size of 60 μm to remove coarse particles and aggregates, whereby [toner 15] was obtained.

Example 16

[Toner base particle 16] was obtained in the same manner as in Example 1, except that [resin dispersion liquid 1] was changed to [resin dispersion liquid 4]. After beating aggregated [toner base particle 16] using HENSHEL MIXER, through observation of the obtained [toner base particle 16] under a scanning electron microscope, the vinyl resin was found to be uniformly fused with the surfaces of the toner core particles. To [toner base particle 16] (100 parts by mass), commercially available silica fine powder H20™ (1.5 parts by mass) (product of Clariant (Japan) K.K.; average primary particle diameter: 12 nm, without silicone oil treatment) and RY50 (2.8 parts by mass) (product of Nippon Aerosil Co., Ltd.; average primary particle diameter: 40 nm, with silicone oil treatment) were added and mixed together using HENSCHEL MIXER, and the resultant mixture was caused to pass through a sieve with an opening size of 60 μm to remove coarse particles and aggregates, whereby [toner 16] was obtained.

Example 17

[Toner base particle 17] was obtained in the same manner as in Example 1, except that [resin dispersion liquid 1] was changed to [resin dispersion liquid 5]. After beating aggregated [toner base particle 17] using HENSHEL MIXER, through observation of the obtained [toner base particle 17] under a scanning electron microscope, the vinyl resin was found to be uniformly fused with the surfaces of the toner core particles. To [toner base particle 17] (100 parts by mass), commercially available silica fine powder H20™ (1.5 parts by mass) (product of Clariant (Japan) K.K.; average primary particle diameter: 12 nm, without silicone oil treatment) and RY50 (2.8 parts by mass) (product of Nippon Aerosil Co., Ltd.; average primary particle diameter: 40 nm, with silicone oil treatment) were added and mixed together using HENSCHEL MIXER, and the resultant mixture was caused to pass through a sieve with an opening size of 60 μm to remove coarse particles and aggregates, whereby [toner 17] was obtained.

Example 18

[Toner base particle 18] was obtained in the same manner as in Example 1, except that [resin dispersion liquid 1] was changed to [resin dispersion liquid 6]. After beating aggregated [toner base particle 18] using HENSHEL MIXER, through observation of the obtained [toner base particle 18] under a scanning electron microscope, the vinyl resin was found to be uniformly fused with the surfaces of the toner core particles. To [toner base particle 18] (100 parts by mass), commercially available silica fine powder H20™ (1.5 parts by mass) (product of Clariant (Japan) K.K.; average primary particle diameter: 12 nm, without silicone oil treatment) and RY50 (2.8 parts by mass) (product of Nippon Aerosil Co., Ltd.; average primary particle diameter: 40 nm, with silicone oil treatment) were added and mixed together using HENSCHEL MIXER, and the resultant mixture was caused to pass through a sieve with an opening size of 60 μm to remove coarse particles and aggregates, whereby [toner 18] was obtained.

Example 19

[Toner base particle 19] was obtained in the same manner as in Example 1, except that [resin dispersion liquid 1] was changed to [resin dispersion liquid 7]. After beating aggregated [toner base particle 19] using HENSHEL MIXER, through observation of the obtained [toner base particle 19] under a scanning electron microscope, the vinyl resin was found to be uniformly fused with the surfaces of the toner core particles. To [toner base particle 19] (100 parts by mass), commercially available silica fine powder H20™ (1.5 parts by mass) (product of Clariant (Japan) K.K.; average primary particle diameter: 12 nm, without silicone oil treatment) and RY50 (2.8 parts by mass) (product of Nippon Aerosil Co., Ltd.; average primary particle diameter: 40 nm, with silicone oil treatment) were added and mixed together using HENSCHEL MIXER, and the resultant mixture was caused to pass through a sieve with an opening size of 60 μm to remove coarse particles and aggregates, whereby [toner 19] was obtained.

Example 20

[Toner base particle 20] was obtained in the same manner as in Example 1, except that [resin dispersion liquid 1] was changed to [resin dispersion liquid 8]. After beating aggregated [toner base particle 20] using HENSHEL MIXER, through observation of the obtained [toner base particle 20] under a scanning electron microscope, the vinyl resin was found to be uniformly fused with the surfaces of the toner core particles. To [toner base particle 20] (100 parts by mass), commercially available silica fine powder H20™ (1.5 parts by mass) (product of Clariant (Japan) K.K.; average primary particle diameter: 12 nm, without silicone oil treatment) and RY50 (2.8 parts by mass) (product of Nippon Aerosil Co., Ltd.; average primary particle diameter: 40 nm, with silicone oil treatment) were added and mixed together using HENSCHEL MIXER, and the resultant mixture was caused to pass through a sieve with an opening size of 60 μm to remove coarse particles and aggregates, whereby [toner 20] was obtained.

Example 21

[Toner base particle 21] was obtained in the same manner as in Example 1, except that [isocyanate-modified polyester 1] was not added. After beating aggregated [toner base particle 21] using HENSHEL MIXER, through observation of the obtained [toner base particle 21] under a scanning electron microscope, the vinyl resin was found to be uniformly fused with the surfaces of the toner core particles. To [toner base particle 21] (100 parts by mass), commercially available silica fine powder H20™ (1.5 parts by mass) (product of Clariant (Japan) K.K.; average primary particle diameter: 12 nm, without silicone oil treatment) and RY50 (2.8 parts by mass) (product of Nippon Aerosil Co., Ltd.; average primary particle diameter: 40 nm, with silicone oil treatment) were added and mixed together using HENSCHEL MIXER, and the resultant mixture was caused to pass through a sieve with an opening size of 60 μm to remove coarse particles and aggregates, whereby [toner 21] was obtained.

Comparative Example 1

[Toner base particle 22] was obtained in the same manner as in Example 1, except that [resin dispersion liquid 1] was not added. After beating aggregated [toner base particle 22] using HENSHEL MIXER, through observation of the obtained [toner base particle 22] under a scanning electron microscope, the toner core particles were found to have no protrusions on their surfaces. Desired protrusions were not formed on the toner surfaces, since the fine resin particle dispersion liquid necessary for forming the protrusions was not added. To [toner base particle 22] (100 parts by mass), commercially available silica fine powder H20™ (1.5 parts by mass) (product of Clariant (Japan) K.K.; average primary particle diameter: 12 nm, without silicone oil treatment) and RY50 (2.8 parts by mass) (product of Nippon Aerosil Co., Ltd.; average primary particle diameter: 40 nm, with silicone oil treatment) were added and mixed together using HENSCHEL MIXER, and the resultant mixture was caused to pass through a sieve with an opening size of 60 μm to remove coarse particles and aggregates, whereby [toner 22] was obtained.

Comparative Example 2

[Toner base particle 23] was obtained in the same manner as in Example 1, except that [resin dispersion liquid 1] was changed to [resin dispersion liquid 9]. After beating aggregated [toner base particle 23]using HENSHEL MIXER, through observation of the obtained [toner base particle 23] under a scanning electron microscope, the toner core particles were found to have no protrusions on their surfaces. The toner core particles had so high compatibility with [fine resin particle dispersion liquid 9] that protrusions could not be formed. To [toner base particle 23] (100 parts by mass), commercially available silica fine powder H20™ (1.5 parts by mass) (product of Clariant (Japan) K.K.; average primary particle diameter: 12 nm, without silicone oil treatment) and RY50 (2.8 parts by mass) (product of Nippon Aerosil Co., Ltd.; average primary particle diameter: 40 nm, with silicone oil treatment) were added and mixed together using HENSCHEL MIXER, and the resultant mixture was caused to pass through a sieve with an opening size of 60 μm to remove coarse particles and aggregates, whereby [toner 23] was obtained.

Comparative Example 3

[Toner 24] was obtained in the same manner as in Example 1, except that after beating aggregated [toner base particle 1] using HENSHEL MIXER, commercially available silica fine powder H20™ (1.5 parts by mass) (product of Clariant (Japan) K.K.; average primary particle diameter: 12 nm, without silicone oil treatment), and RY50 (2.8 parts by mass) (product of Nippon Aerosil Co., Ltd.; average primary particle diameter: 40 nm, with silicone oil treatment) were not added.

Comparative Example 4

[Toner 25] was obtained in the same manner as in Example 1, except that after beating aggregated [toner base particle 1] using HENSHEL MIXER, to [toner base particle 1] (100 parts by mass), commercially available silica fine powder H20™ (1.5 parts by mass) (product of Clariant (Japan) K.K.; average primary particle diameter: 12 nm, without silicone oil treatment) and RX50 (2.8 parts by mass) (product of Nippon Aerosil Co., Ltd.; average primary particle diameter: 40 nm, without silicone oil treatment) were added and mixed together using HENSCHEL MIXER, and the resultant mixture was caused to pass through a sieve with an opening size of 60 μm to remove coarse particles and aggregates.

Comparative Example 5

[Toner base particle 26] was obtained in the same manner as in Example 1, except that the amount of [resin dispersion liquid 1] was changed from 106 parts by mass to 530 parts by mass, and that 105 parts by mass of 48.5% aqueous solution of sodium dodecyl diphenyl ether disulfonate was added simultaneously with the addition of [resin dispersion liquid 1]. After beating aggregated [toner base particle 26] using HENSHEL MIXER, through observation of the obtained [toner base particle 26] under a scanning electron microscope, the vinyl resin was found to be ununiformly attached to or fused with the surfaces of the toner core particles. Although the surfaces of the toner core particles were virtually covered with the fine resin particles, the protrusions became large. To [toner base particle 26] (100 parts by mass), commercially available silica fine powder H20™ (1.5 parts by mass) (product of Clariant (Japan) K.K.; average primary particle diameter: 12 nm, without silicone oil treatment) and RY50 (2.8 parts by mass) (product of Nippon Aerosil Co., Ltd.; average primary particle diameter: 40 nm, with silicone oil treatment) were added and mixed together using HENSCHEL MIXER, and the resultant mixture was caused to pass through a sieve with an opening size of 60 μm to remove coarse particles and aggregates, whereby [toner 26] was obtained.

Comparative Example 6

[Toner base particle 27] was obtained in the same manner as in Example 1, except that the amount of the 48.5% aqueous solution of sodium dodecyl diphenyl ether disulfonate in [aqueous phase 1] was changed from 95 parts by mass to 200 parts by mass. After beating aggregated [toner base particle 27] using HENSHEL MIXER, through observation of the obtained [toner base particle 27] under a scanning electron microscope, almost all of the vinyl resin which had been attached to or fused with the surface of the toner core particles were exfoliated therefrom. The toner core particles were stabilized by an excess amount of the surfactant and thus, the fine resin particles were not uniformly embedded in the toner core particles, making the protrusions considerably ununiform. To [toner base particle 27] (100 parts by mass), commercially available silica fine powder H20™ (1.5 parts by mass) (product of Clariant (Japan) K.K.; average primary particle diameter: 12 nm, without silicone oil treatment) and RY50 (2.8 parts by mass) (product of Nippon Aerosil Co., Ltd.; average primary particle diameter: 40 nm, with silicone oil treatment) were added and mixed together using HENSCHEL MIXER, and the resultant mixture was caused to pass through a sieve with an opening size of 60 μm to remove coarse particles and aggregates, whereby [toner 27] was obtained.

Comparative Example 7

Figure 2B:
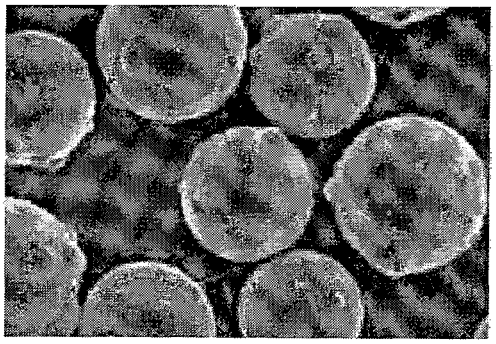
FIG. 2B is an SEM image of toner base particles produced in Comparative Example 7.

[Toner base particle 28] was obtained in the same manner as in Example 1, except that [resin dispersion liquid 1] was added to [aqueous phase 1]. After beating aggregated [toner base particle 28] using HENSHEL MIXER, through observation of the obtained [toner base particle 28] under a scanning electron microscope, the vinyl resin was found to be ununiformly attached to or fused with the surfaces of the toner core particles. Since the fine resin particles were added before formation of the toner core particles, the fine resin particles embedded in the toner core particles became ununiform, leading to formation of ununiform protrusions as illustrated in FIG. 2B. To [toner base particle 28] (100 parts by mass), commercially available silica fine powder H20™ (1.5 parts by mass) (product of Clariant (Japan) K.K.; average primary particle diameter: 12 nm, without silicone oil treatment) and RY50 (2.8 parts by mass) (product of Nippon Aerosil Co., Ltd.; average primary particle diameter: 40 nm, with silicone oil treatment) were added and mixed together using HENSCHEL MIXER, and the resultant mixture was caused to pass through a sieve with an opening size of 60 μm to remove coarse particles and aggregates, whereby [toner 28] was obtained.

Comparative Example 8

Figure 2C:
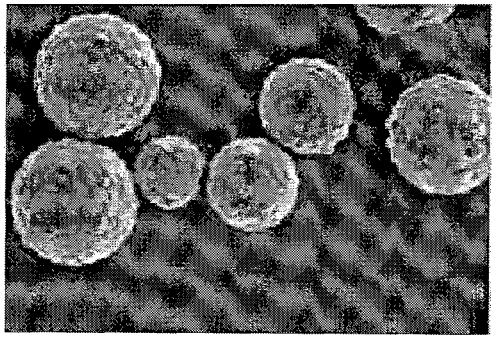
FIG. 2C is an SEM image of toner base particles produced in Comparative Example 8.

[Toner base particle 29] was obtained in the same manner as in Example 1, except that [resin dispersion liquid 1] was changed to [resin dispersion liquid 10]. After beating aggregated [toner base particle 29] using HENSHEL MIXER, through observation of the obtained [toner base particle 29] under a scanning electron microscope, the vinyl resin was found to be ununiformly attached to or fused with the surfaces of the toner core particles. The toner core particles had so high compatibility with [fine resin particle dispersion liquid 10] that protrusions became slightly large as illustrated in FIG. 2C. To [toner base particle 29] (100 parts by mass), commercially available silica fine powder H20™ (1.5 parts by mass) (product of Clariant (Japan) K.K.; average primary particle diameter: 12 nm, without silicone oil treatment) and RY50 (2.8 parts by mass) (product of Nippon Aerosil Co., Ltd.; average primary particle diameter: 40 nm, with silicone oil treatment) were added and mixed together using HENSCHEL MIXER, and the resultant mixture was caused to pass through a sieve with an opening size of 60 μm to remove coarse particles and aggregates, whereby [toner 29] was obtained.

Comparative Example 9

Figure 2D:
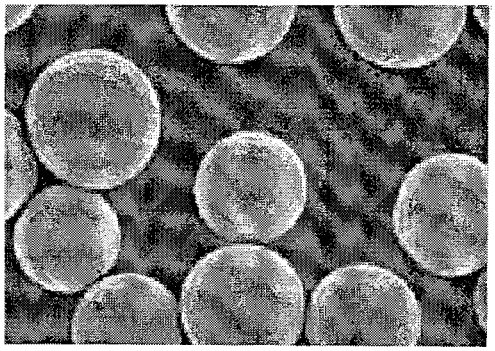
FIG. 2D is an SEM image of toner base particles produced in Comparative Example 9.

[Toner base particle 30] was obtained in the same manner as in Example 1, except that [resin dispersion liquid 1] was changed to [resin dispersion liquid 11]. After beating aggregated [toner base particle 30] using HENSHEL MIXER, through observation of the obtained [toner base particle 30] under a scanning electron microscope, the vinyl resin was found to be ununiformly attached to or fused with the surfaces of the toner core particles. The toner core particles had so high compatibility with [fine resin particle dispersion liquid 11] that almost all portions of the protrusions embedded in the toner core particle to thereby decrease the coverage rate as illustrated in FIG. 2D. To [toner base particle 30] (100 parts by mass), commercially available silica fine powder H20™ (1.5 parts by mass) (product of Clariant (Japan) K.K.; average primary particle diameter: 12 nm, without silicone oil treatment) and RY50 (2.8 parts by mass) (product of Nippon Aerosil Co., Ltd.; average primary particle diameter: 40 nm, with silicone oil treatment) were added and mixed together using HENSCHEL MIXER, and the resultant mixture was caused to pass through a sieve with an opening size of 60 μm to remove coarse particles and aggregates, whereby [toner 30] was obtained.

Comparative Example 10

[Toner base particle 31] was obtained in the same manner as in Example 1, except that a mixture of [resin dispersion liquid 1] (106 parts by mass) with ion-exchange water (71 parts by mass) was changed to a mixture of [resin dispersion liquid 1] (10 parts by mass) with ion-exchange water (7 parts by mass) in <formation of protrusions>. After beating aggregated [toner base particle 31] using HENSHEL MIXER, through observation of the obtained [toner base particle 31] under a scanning electron microscope, the vinyl resin was found to be ununiformly attached to or fused with the surfaces of the toner core particles. To [toner base particle 31] (100 parts by mass), commercially available silica fine powder H20™ (1.5 parts by mass) (product of Clariant (Japan) K.K.; average primary particle diameter: 12 nm, without silicone oil treatment) and RY50 (2.8 parts by mass) (product of Nippon Aerosil Co., Ltd.; average primary particle diameter: 40 nm, with silicone oil treatment) were added and mixed together using HENSCHEL MIXER, and the resultant mixture was caused to pass through a sieve with an opening size of 60 μm to remove coarse particles and aggregates, whereby [toner 31] was obtained.

The physical properties and evaluation results with the following methods of each of the above-obtained toners are summarized in Tables 1-1 and 1-2, and Tables 2-1 and 2-2, respectively.

<Background Smear>

After printing of 2,000 sheets having a chart with an image area ratio of 1% using a color electrophotographic apparatus (IPSIO SP C220, product of Ricoh Company, Ltd.), a piece of Scotch (registered trademark, product of Sumitomo 3M Limited) tape was used to remove the toner attached on the photoconductor having been subjected to printing of white solid images, and the piece of tape was attached to blank paper. Then, the color difference ΔE was measured with a spectrodensitometer (product of X-Rite, Incorporated.) and evaluated on the basis of the following 4 ranks.

—Evaluation Criteria—

A: $\Delta E<3$

B: $3\leq\Delta E<5$

C: $5\leq\Delta E<10$

D: $10\leq\Delta E$

<Adhesion Resistance>

After printing of 2,000 sheets having a white solid image using a color electrophotographic apparatus (IPSIO SP C220, product of Ricoh Company, Ltd.), toner particles adhered to a regulating blade was evaluated on the basis of the following 4 ranks.

A: No toner particles was adhered to a regulating blade; very good

B: Toner particles were adhered to a regulating blade to such an extent that image quality was not adversely affected C: Toner particles were adhered to a regulating blade to such an extent that image quality was adversely affected D: Noticeable toner particles were adhered to a regulating blade, giving great adverse effects to image quality <Transfer Rate>

After printing of 2,000 sheets having a chart with an image area ratio of 1% using a color electrophotographic apparatus (IPSIO SP C220, product of Ricoh Company, Ltd.), the amount of the toner on the photoconductor and the amount of the toner of the black solid image (7.8 cm×1.0 cm) on the transfer belt were measured. The thus-measured amounts were used to calculate a transfer rate from the following equation:

Transfer rate=(the amount of the toner on the transfer belt/the amount of the toner on the photoconductor)×100

The obtained transfer rate was evaluated on the basis of the following 4 ranks.

—Evaluation Criteria—

A: 90%≤Transfer rate

B: 80%≤Transfer rate<90%

C: 70%≤Transfer rate<80%

D: Transfer rate<70%

<Transfer unevenness>

After printing of 2,000 sheets having a chart with an image area ratio of 1% using a color electrophotographic apparatus (IPSIO SP C220, product of Ricoh Company, Ltd.), the black solid image (7.8 cm×1.0 cm) on the transfer belt was evaluated for transfer unevenness on the basis of the following 4 ranks by comparing with standard samples.

—Evaluation Criteria—

A: No transfer unevenness was observed, very good

B: Transfer unevenness was observed to such an extent that image quality was not adversely affected C: Transfer unevenness was observed to such an extent that image quality was adversely affected D: Noticeable transfer unevenness was observed, giving great adverse effects to image quality <Halftone Reproducibility>

After printing of 2,000 sheets having a chart with an image area ratio of 1% using a color electrophotographic apparatus (IPSIO SP C220, product of Ricoh Company, Ltd.), halftone image in which one dot image and one dot white image were alternately recorded repeatedly was printed on paper (TYPE 6000, product of Ricoh Company, Ltd.) and evaluated for halftone reproducibility on the basis of the following 4 ranks by comparing with standard samples.

—Evaluation Criteria—

A: Reproducibility was very good

B: Reproducibility was determined to such an extent that image quality was not adversely affected C: Reproducibility was determined to such an extent that image quality was adversely affected D: Reproducibility was determined to such an extent that gives great adverse effects to image quality <Change of Image Density>

Before and after printing of 2,000 sheets having a chart with an image area ratio of 1% using a color electrophotographic apparatus (IPSIO SP C220, product of Ricoh Company, Ltd.), a black solid image was printed on paper (TYPE 6000, product of Ricoh Company, Ltd.). Then, the image density was measured with a spectrodensitometer (product of X-Rite, Incorporated) and evaluated for a change in image density; i.e., the difference in reflectance measured by the above spectrodensitometer between before and after printing of 2,000 sheets (reflectance before printing of 2,000 sheets—reflectance after printing of 2,000 sheets).

—Evaluation Criteria—

A: Difference<0.1%

B: 0.1%≤Difference<0.2%

C: 0.2%≤Difference<0.3%

D: 0.3%≤Difference

<Cleanability>

After printing of 2,000 sheets having a chart with an image area ratio of 1% using a color electrophotographic apparatus (IPSIO SP C220, product of Ricoh Company, Ltd.), a white solid image was printed out and evaluated for the presence or absence of cleaning failures on the basis of the following 4 ranks.

—Evaluation Criteria—

A: No cleaning failure was observed, very good

B: Cleaning failure was observed but non-problematic in practical use

C: Cleaning failure was observed and problematic in practical use

D: Noticeable cleaning failure was observed

<Charging Roller Smear>

After printing of 2,000 sheets having a chart with an image area ratio of 1% using a color electrophotographic apparatus (IPSIO SP C220, product of Ricoh Company, Ltd.), a surface of the charging roller was visually evaluated for smear on the basis of the following 4 ranks.

—Evaluation Criteria—

A: No roller smear was observed, very good

B: Roller smear was observed but non-problematic in practical use

C: Roller smear was observed and problematic in practical use

D: Noticeable roller smear was observed

<Photoconductor Abrasion>

After printing of 2,000 sheets having a chart with an image area ratio of 1% using a color electrophotographic apparatus (IPSIO SP C220, product of Ricoh Company, Ltd.), a surface of the charging roller was visually evaluated for abrasion on the basis of the following 4 ranks.

—Evaluation Criteria—

A: No streaky abrasion was observed, very good

B: Streaky abrasion was observed but non-problematic in practical use

C: Streaky abrasion was observed and problematic in practical use

D: Noticeable streaky abrasion was observed

<Fish-Shaped Mark of Photoconductor>

After printing of 2,000 sheets having a chart with an image area ratio of 1% using a color electrophotographic apparatus (IPSIO SP C220, product of Ricoh Company, Ltd.), a surface of the presence of fish-shaped mark (formed as follows: firstly, additives contained in toner particles and paper powder are attached to a photoconductor, and the toner particles and others are in turn attached to the photoconductor with the additives and paper powder serving as a core, which looks like icicles, and then elongated streaky) was evaluated visually and with the black solid image on the basis of the following 4 ranks.

—Evaluation Criteria—

A: No fish-shaped mark was observed, very good

B: Fish-shaped mark was observed to such an extent that image quality was not adversely affected C: Fish-shaped mark was observed to such an extent that image quality was adversely affected D: Noticeable fish-shaped mark was observed, giving great adverse effects to image quality

TABLE 1-1

| | Toner base particle | | | | | |
|---|---|---|---|---|---|---|
| | | | Protrusions | | | |
| | Average particle diameter (μm) | Sphe-ricity | Long side length (μm) | Standard devia-tion | Cover-age rate (%) | Mass rate to total mass of toner (%) |
| Ex. 1 | 6.5 | 0.985 | 0.23 | 0.10 | 56 | 3.92 |
| Ex. 2 | 6.5 | 0.985 | 0.23 | 0.10 | 56 | 3.92 |
| Ex. 3 | 6.5 | 0.985 | 0.23 | 0.10 | 56 | 3.92 |
| Ex. 4 | 6.5 | 0.985 | 0.23 | 0.10 | 56 | 3.92 |
| Ex. 5 | 6.5 | 0.985 | 0.23 | 0.10 | 56 | 3.92 |
| Ex. 6 | 6.5 | 0.985 | 0.23 | 0.10 | 56 | 3.92 |
| Ex. 7 | 6.5 | 0.985 | 0.23 | 0.10 | 56 | 3.92 |
| Ex. 8 | 6.5 | 0.985 | 0.23 | 0.10 | 56 | 3.92 |
| Ex. 9 | 6.5 | 0.985 | 0.23 | 0.10 | 56 | 3.92 |
| Ex. 10 | 6.5 | 0.985 | 0.23 | 0.10 | 56 | 3.92 |
| Ex. 11 | 6.5 | 0.985 | 0.23 | 0.10 | 56 | 3.92 |
| Ex. 12 | 6.5 | 0.985 | 0.23 | 0.10 | 56 | 3.92 |
| Ex. 13 | 6.5 | 0.985 | 0.23 | 0.10 | 56 | 3.92 |
| Ex. 14 | 6.6 | 0.985 | 0.26 | 0.11 | 51 | 3.65 |
| Ex. 15 | 6.8 | 0.986 | 0.27 | 0.12 | 54 | 4.12 |
| Ex. 16 | 6.7 | 0.980 | 0.39 | 0.10 | 53 | 4.28 |
| Ex. 17 | 7.6 | 0.980 | 0.22 | 0.09 | 49 | 4.43 |
| Ex. 18 | 8.6 | 0.976 | 0.29 | 0.12 | 52 | 3.65 |
| Ex. 19 | 6.7 | 0.980 | 0.25 | 0.10 | 32 | 3.89 |
| Ex. 20 | 6.6 | 0.985 | 0.23 | 0.09 | 81 | 4.22 |
| Ex. 21 | 8.1 | 0.986 | 0.34 | 0.12 | 36 | 3.16 |

TABLE 1-2

| | Toner base particle | | | | | |
|---|---|---|---|---|---|---|
| | | | Protrusions | | | |
| | Average particle diameter (μm) | Sphe-ricity | Long side length (μm) | Standard devia-tion | Cover-age rate (%) | Mass rate to total mass of toner (%) |
| Comp. Ex. 1 | 5.7 | 0.986 | — | — | — | — |
| Comp. Ex. 2 | 8.1 | 0.980 | — | — | — | — |
| Comp. Ex. 3 | 6.5 | 0.985 | 0.23 | 0.10 | 56 | 3.92 |
| Comp. Ex. 4 | 6.5 | 0.985 | 0.23 | 0.10 | 56 | 3.92 |
| Comp. Ex. 5 | 4.9 | 0.931 | 0.40 | 0.22 | 98 | 2.55 |
| Comp. Ex. 6 | 5.5 | 0.982 | — | — | — | 0.31 |

TABLE 1-2-continued

| | Toner base particle | | | | | |
|---|---|---|---|---|---|---|
| | | | Protrusions | | | |
| | Average particle diameter (μm) | Sphe-ricity | Long side length (μm) | Standard devia-tion | Cover-age rate (%) | Mass rate to total mass of toner (%) |
| Comp. Ex. 7 | 6.7 | 0.978 | 0.72 | 0.49 | 23 | 0.87 |
| Comp. Ex. 8 | 6.7 | 0.986 | 0.52 | 0.22 | 67 | 3.80 |
| Comp. Ex. 9 | 6.9 | 0.987 | 0.23 | 0.11 | 6 | 4.32 |
| Comp. Ex. 10 | 6.0 | 0.987 | 0.25 | 0.12 | 8 | 0.22 |

TABLE 2-1

| | Back-ground smear | Adhesion resistance | Transfer rate | Transfer unevenness | Halftone repro-ducibility |
|---|---|---|---|---|---|
| Ex. 1 | A | A | A | A | A |
| Ex. 2 | A | A | A | A | A |
| Ex. 3 | A | A | A | A | A |
| Ex. 4 | A | A | A | A | A |
| Ex. 5 | A | A | A | A | A |
| Ex. 6 | A | A | A | A | A |
| Ex. 7 | A | A | A | A | A |
| Ex. 8 | A | A | A | B | B |
| Ex. 9 | B | A | A | A | A |
| Ex. 10 | B | A | B | B | B |
| Ex. 11 | B | A | B | B | B |
| Ex. 12 | A | A | A | B | B |
| Ex. 13 | A | A | A | B | B |
| Ex. 14 | B | A | A | A | A |
| Ex. 15 | B | B | A | B | B |
| Ex. 16 | A | A | A | A | A |
| Ex. 17 | B | B | A | A | A |
| Ex. 18 | A | A | A | A | A |
| Ex. 19 | A | A | A | A | A |
| Ex. 20 | A | A | A | A | A |
| Ex. 21 | A | A | A | A | A |
| Comp. Ex. 1 | D | C | D | D | D |
| Comp. Ex. 2 | D | C | D | D | D |
| Comp. Ex. 3 | D | D | D | D | D |
| Comp. Ex. 4 | B | D | C | C | B |
| Comp. Ex. 5 | D | D | D | D | D |
| Comp. Ex. 6 | D | D | D | D | D |
| Comp. Ex. 7 | D | D | D | D | D |
| Comp. Ex. 8 | C | B | B | B | C |
| Comp. Ex. 9 | D | B | B | C | C |
| Comp. Ex. 10 | D | C | D | D | D |

TABLE 2-2

| | Change of image density | Cleanability | Charging roller smear | Photoconductor membrane abrasion | Photoconductor Fish-shaped mark |
|---|---|---|---|---|---|
| Ex. 1 | A | B | A | A | A |
| Ex. 2 | A | A | A | A | A |
| Ex. 3 | A | B | A | A | A |
| Ex. 4 | A | B | A | A | A |
| Ex. 5 | A | B | A | A | A |
| Ex. 6 | A | B | A | A | A |
| Ex. 7 | A | B | A | A | A |
| Ex. 8 | A | B | A | A | A |
| Ex. 9 | B | B | A | A | A |
| Ex. 10 | B | A | A | A | A |
| Ex. 11 | B | A | A | A | A |
| Ex. 12 | B | B | A | B | A |
| Ex. 13 | B | B | A | B | A |

TABLE 2-2-continued

| | Change of image density | Cleanability | Charging roller smear | Photoconductor membrane abrasion | Photoconductor Fish-shaped mark |
|---|---|---|---|---|---|
| Ex. 14 | A | B | A | A | A |
| Ex. 15 | A | B | A | A | A |
| Ex. 16 | A | B | A | A | A |
| Ex. 17 | A | B | A | A | A |
| Ex. 18 | A | B | A | A | A |
| Ex. 19 | A | B | A | A | A |
| Ex. 20 | A | B | A | A | A |
| Ex. 21 | A | B | A | A | A |
| Comp. Ex. 1 | D | D | C | A | B |
| Comp. Ex. 2 | D | D | C | A | B |
| Comp. Ex. 3 | D | B | A | A | B |
| Comp. Ex. 4 | A | C | A | D | D |
| Comp. Ex. 5 | D | B | D | C | D |
| Comp. Ex. 6 | D | B | D | C | D |
| Comp. Ex. 7 | D | B | D | C | D |
| Comp. Ex. 8 | C | B | B | B | B |
| Comp. Ex. 9 | C | D | C | C | C |
| Comp. Ex. 10 | D | D | C | A | B |

The embodiments of the present invention are as follows.

<1> An electrostatic image developing toner including:

toner base particles each including a binder resin and a colorant; and an external additive, wherein the toner base particles each have protrusions on a surface thereof, wherein an average of lengths of long sides of the protrusions is 0.1 μm or more but less than 0.5 μm, wherein a standard deviation of the lengths of the long sides of the protrusions is 0.2 or less, wherein a coverage rate of the protrusions on the surface of each toner base particle is 10% to 90%, and wherein the external additive includes an external additive (A) which is fine inorganic particles each containing silicone oil.

<2> The electrostatic image developing toner according to <1>, wherein an amount of the external additive (A) is 1.0% by mass to 5.0% by mass relative to the toner base particles.

<3> The electrostatic image developing toner according to <1> or <2>, wherein the external additive further includes an external additive (B) containing no silicone oil, and an amount of the external additive (B) is 5.0% by mass or less relative to the toner base particles.

<4> The electrostatic image developing toner according to any one of <1> to <3>, wherein the protrusions are made of a resin, and the resin is obtained by polymerizing a monomer mixture containing styrene.

<5> The electrostatic image developing toner according to <4>, wherein a rate of a mass of the resin of which the protrusions are made to a total mass of the toner is 1% by mass to 20% by mass.

<6> The electrostatic image developing toner according to any one of <1> to <5>, wherein the toner base particles are obtained by a method including: producing toner core particles; and attaching or fusing, onto surfaces of the toner core particles, the resin of which the protrusions are made, to thereby form the protrusions.

<7> The electrostatic image developing toner according to <6>, wherein the toner core particles are obtained through granulation performed by emulsifying or dispersing, in an aqueous medium, an oil phase containing at least the binder resin and the colorant.

<8> The electrostatic image developing toner according to <6> or <7>, wherein the attaching or fusing is adding an aqueous dispersion liquid of fine resin particles to an aqueous medium containing the toner core particles emulsified or dispersed therein, to attach or fuse the fine resin particles onto surfaces of the toner core particles.

<9> A toner container including:

the electrostatic image developing toner according to any one of <1> to <8>, and a container, which houses the electrostatic image developing toner.

<10> A developer including:

the electrostatic image developing toner according to any one of <1> to <8>.

<11> An image forming apparatus including:

a latent image bearing member which bears a latent image thereon, a charging unit configured to uniformly charge a surface of the latent image bearing member, an exposing unit configured to expose the charged surface of the latent image bearing member to light based on image data to form a latent electrostatic image, a developing unit configured to develop, with a toner, the latent electrostatic image formed on the surface of the latent image bearing member, to thereby form a visible image on the surface of the latent image bearing member, a transfer unit configured to transfer, onto an image-receiving medium, the visible image formed on the surface of the latent image bearing member, and a fixing unit configured to fix the transferred visible image on the image-receiving medium, wherein the toner is the electrostatic image developing toner according to any one of <1> to <8>.

<12> An image forming method including:

uniformly charging a surface of a latent image bearing member;

exposing the charged surface of the latent image bearing member to light based on image data to form a latent electrostatic image, developing, with a toner, the latent electrostatic image formed on the surface of the latent image bearing member to form a visible image on the surface of the latent image bearing member, transferring, onto an image-receiving medium, the visible image on the surface of the latent image bearing member, and fixing the transferred visible image on the image-receiving medium, wherein the toner is the electrostatic image developing toner according to any one of <1> to <8>.

<13> A process cartridge including:

a latent image bearing member which bears a latent image thereon, and a developing unit configured to develop, with a toner, a latent electrostatic image formed on the surface of the latent image bearing member, to thereby form a visible image on the surface of the latent image bearing member, wherein the process cartridge is mounted detachably to the main body of an image forming apparatus, and wherein the toner is the electrostatic image developing toner according to any one of <1> to <8>.

REFERENCE SIGNS LIST

1 latent image bearing member
2 charging unit
3 exposing unit
4 developing unit
5 cleaning unit
6 intermediate transfer member
7 supporting roller
8 transfer roller
9 heating roller
10 aluminum core
11 elastic material layer
12 surface layer
13 heater
14 press roller
15 aluminum core
16 elastic material layer
17 surface layer
18 unfixed image
19 fixing unit
40 developing roller
41 thin layer-forming member
42 supply roller
T toner particle

The invention claimed is:

1. An electrostatic image developing toner comprising:

toner base particles each comprising a binder resin and a colorant; and an external additive in an amount of from 1.0% by mass to 5.0% by mass relative to the toner base particles;

wherein the toner base particles each have protrusions on a surface thereof, an average of lengths of long sides of the protrusions is 0.1 μm or more but less than 0.5 μm, a standard deviation of the lengths of the long sides of the protrusions is 0.2 or less, a coverage rate of the protrusions on the surface of each toner base particle is from 10% to 90%, and the external additive comprises an external additive (A) which is fine inorganic particles each comprising silicone oil and wherein the external additive further comprises an external additive (B) comprising no silicone oil, and an amount of the external additive (B) is from 5.0% by mass or less relative to the toner base particles.

2. The toner according to claim 1, wherein the protrusions comprise a resin, and the resin is obtained by polymerizing a monomer mixture comprising styrene.

3. The toner according to claim 2, wherein a rate of a mass of the resin to a total mass of the toner is from 1% by mass to 20% by mass.

4. The toner according to claim 2, wherein the toner base particles are obtained by a method comprising:

producing toner core particles; and attaching or fusing, onto surfaces of the toner core particles, the resin, to thereby form the protrusions.

5. The toner according to claim 4, wherein the toner core particles are obtained by granulation performed by emulsifying or dispersing, in an aqueous medium, an oil phase comprising at least the binder resin and the colorant.

6. The toner according to claim 4, wherein the attaching or fusing comprises adding an aqueous dispersion liquid of fine resin particles to an aqueous medium comprising the toner core particles emulsified or dispersed therein, to attach or fuse the fine resin particles onto surfaces of the toner core particles.

7. An image forming apparatus comprising:

a latent image bearing member which bears a latent image thereon, a charging unit configured to uniformly charge a surface of the latent image bearing member, an exposing unit configured to expose the charged surface of the latent image bearing member to light based on image data to form a latent electrostatic image, a developing unit configured to develop, with a toner, the latent electrostatic image formed on the surface of the latent image bearing member, to thereby form a visible image on the surface of the latent image bearing member, a transfer unit configured to transfer, onto an image-receiving medium, the visible image formed on the surface of the latent image bearing member, and a fixing unit configured to fix the transferred visible image on the image-receiving medium, wherein the toner is an electrostatic image developing toner comprising:

toner base particles each comprising a binder resin and a colorant; and an external additive in an amount of from 1.0% by mass to 5.0% by mass relative to the toner base particles, wherein the toner base particles each have protrusions on a surface thereof, an average of lengths of long sides of the protrusions is 0.1 μm or more but less than 0.5 μm, a standard deviation of the lengths of the long sides of the protrusions is 0.2 or less, a coverage rate of the protrusions on the surface of each toner base particle is from 10% to 90%, and the external additive comprises an external additive (A) which is fine inorganic particles each comprising silicone oil and wherein the external additive further comprises an external additive (B) comprising no silicone oil, and an amount of the external additive (B) is from 5.0% by mass or less relative to the toner base particles.

8. A process cartridge comprising:

a latent image bearing member which bears a latent image thereon, and a developing unit configured to develop, with a toner, a latent electrostatic image formed on the surface of the latent image bearing member, to thereby form a visible image on the surface of the latent image bearing member, wherein the process cartridge is mounted detachably to the main body of an image forming apparatus, and wherein the toner is an electrostatic image developing toner comprising:

toner base particles each comprising a binder resin and a colorant; and an external additive in an amount of from 1.0% by mass to 5.0% by mass relative to the toner base particles, wherein the toner base particles each have protrusions on a surface thereof, an average of lengths of long sides of the protrusions is 0.1 μm or more but less than 0.5 μm, a standard deviation of the lengths of the long sides of the protrusions is 0.2 or less, a coverage rate of the protrusions on the surface of each toner base particle is from 10% to 90%, and the external additive comprises an external additive (A) which is fine inorganic particles each comprising silicone oil and wherein the external additive further comprises an external additive (B) comprising no silicone oil, and an amount of the external additive (B) is from 5.0% by mass or less relative to the toner base particles.

9. The apparatus according to claim 7, wherein the protrusions comprise a resin, and the resin is obtained by polymerizing a monomer mixture comprising styrene.

10. The apparatus according to claim 9, wherein a rate of a mass of the resin to a total mass of the toner is from 1% by mass to 20% by mass.

11. The apparatus according to claim 7, wherein the toner base particles are obtained by a method comprising:

producing toner core particles; and attaching or fusing, onto surfaces of the toner core particles, the resin, to thereby form the protrusions.

12. The process cartridge according to claim 8, wherein the external additive further comprises an external additive (B) comprising no silicone oil, and an amount of the external additive (B) is 5.0% by mass or less relative to the toner base particles.

13. The process cartridge according to claim 8, wherein the protrusions comprise a resin, and the resin is obtained by polymerizing a monomer mixture comprising styrene.

14. The process cartridge according to claim 13, wherein a rate of a mass of the resin to a total mass of the toner is from 1% by mass to 20% by mass.

15. The process cartridge according to claim 8, wherein the toner base particles are obtained by a method comprising:

producing toner core particles; and attaching or fusing, onto surfaces of the toner core particles, the resin, to thereby form the protrusions.

* * * * *